US011099500B2

(12) United States Patent
Suzuki et al.

(10) Patent No.: US 11,099,500 B2
(45) Date of Patent: Aug. 24, 2021

(54) IMAGE FORMING APPARATUS HAVING TONER REPLENISHMENT

(71) Applicant: CANON KABUSHIKI KAISHA, Tokyo (JP)

(72) Inventors: Ai Suzuki, Tokyo (JP); Shinsuke Kobayashi, Yokohama (JP); Kensuke Umeda, Kawasaki (JP); Takanori Watanabe, Kawasaki (JP); Kazuhiro Funatani, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/806,060

(22) Filed: Mar. 2, 2020

(65) Prior Publication Data

US 2020/0292960 A1 Sep. 17, 2020

(30) Foreign Application Priority Data

Mar. 15, 2019 (JP) ..... JP2019-049202

(51) Int. Cl.
*G03G 15/08* (2006.01)
*G03G 21/00* (2006.01)
(Continued)

(52) U.S. Cl.
CPC ..... *G03G 15/0862* (2013.01); *G03G 15/0867* (2013.01); *G03G 15/0889* (2013.01);
(Continued)

(58) Field of Classification Search
None
See application file for complete search history.

(56) References Cited

U.S. PATENT DOCUMENTS 5,091,750 A * 2/1992 Yoshida ..... G03G 15/0886 399/106
5,918,094 A * 6/1999 Masuda ..... G03G 15/0856 399/258
(Continued)

FOREIGN PATENT DOCUMENTS

JP H08-30084 A 2/1996
JP 2017-058601 A 3/2017
JP 2018-036298 A 3/2018

*Primary Examiner* — Victor Verbitsky
(74) *Attorney, Agent, or Firm* — Venable LLP

(57) ABSTRACT

An image forming apparatus includes a rotatable image bearing member to bear an electrostatic latent image, a developing container to accommodate developer including toner and to allow new developer to be replenished by a developer replenishing container, and a developer bearing member to develop the electrostatic latent image into a toner image by using the developer in the developing container. A transfer roller transfers the toner image born on the image bearing member onto the recording material, and a controller notifies replenishment information for prompting replenishing the developing container with the new developer by the developer replenishing container. The controller notifies the replenishment information in a state in which an index correlated with a ratio of an amount of paper dust mixed in the developer in the developing container to an amount of the developer in the developing container has not exceeded a preset threshold value of the index.

19 Claims, 18 Drawing Sheets

(51) Int. Cl.
*G03G 21/10* (2006.01)
*G03G 15/00* (2006.01)
*G03G 21/12* (2006.01)

(52) U.S. Cl.
CPC ..... *G03G 15/5016* (2013.01); *G03G 21/0058* (2013.01); *G03G 21/105* (2013.01); *G03G 21/12* (2013.01); *G03G 2221/0042* (2013.01); *G03G 2221/0057* (2013.01)

(56) References Cited

U.S. PATENT DOCUMENTS 6,192,212 B1 * 2/2001 Kunihiro ..... G03G 21/105 399/253
2001/0031154 A1 * 10/2001 Sato ..... G03G 21/1814 399/127
2016/0170327 A1 * 6/2016 Saito ..... G03G 15/0822 399/27

* cited by examiner

IMAGE FORMING APPARATUS HAVING TONER REPLENISHMENT

BACKGROUND OF THE INVENTION

Field of the Invention

The present invention relates to an image forming apparatus configured to form an image on a recording material by using toner.

Description of the Related Art

Generally, an image forming apparatus of an electrophotographic system forms an image by drawing an electrostatic latent image on the surface of an image bearing member such as a photosensitive drum, developing the electrostatic latent image by using toner, and transferring the developed toner image onto a recording material such as paper. Examples of a system of replenishing a developing unit with toner consumed for the development include a cartridge system in which the developing unit itself is replaced, and a toner replenishment system in which the developing unit is replenished with only the toner. In addition, examples of the toner replenishment system include a successive replenishment system in which a small amount of toner is successively supplied to the developing unit from a container such as a toner bottle, and a direct replenishment system in which a user directly supplies toner to the developing unit in the case where the amount of remaining toner in the developing unit has become small.

Meanwhile, it is known that there is a case where, when paper dust of talc, calcium carbonate, or the like used as filler of paper enters the developing unit in an image forming apparatus of an electrophotographic system, the amount of charges of toner decreases and an image defect occurs. In the case where the toner charge amount is insufficient, so-called background fogging in which a thin layer of toner is attached to a region where an image is not supposed to be formed may occur. Japanese Patent Laid-Open No. 2017-058601 discloses disposing a foreign substance removing member of a brush shape in contact with a developing member to keep foreign substance such as talc from mixing into the developer.

In the case of the cartridge system, the developing unit is replaced by a brand-new one in which paper dust is not accumulated even if a certain amount of paper dust has entered the developing unit, and therefore the influence of the paper dust is not likely to be apparent. However, in the configuration of a toner replenishment system, toner is replenished in a state in which the developing unit is attached to the image forming apparatus, and therefore paper dust is gradually accumulated in the developing unit.

SUMMARY OF THE INVENTION

The present invention provides an image forming apparatus capable of reducing a possibility of occurrence of background fogging caused by paper dust.

According to one aspect of the invention, an image forming apparatus is configured to form an image on a recording material, the image forming apparatus including: a rotatable image bearing member configured to bear an electrostatic latent image; a developing container configured to accommodate developer including toner; a developing member configured to develop the electrostatic latent image born on the image bearing member into a toner image by using the developer in the developing container; a transfer member configured to transfer the toner image born on the image bearing member onto the recording material; and a notification portion configured to notify replenishment information for prompting replenishing the developing container with the developer, the notification portion being configured to notify the replenishment information in a state in which an index correlated with a ratio of an amount of paper dust mixed in the developer in the developing container to an amount of the developer in the developing container has not exceeded a preset threshold value of the index.

According to another aspect of the invention, an image forming apparatus is configured to form an image on a recording material, the image forming apparatus including: a rotatable image bearing member configured to bear an electrostatic latent image; a developing container configured to accommodate developer including toner; a developing member configured to develop the electrostatic latent image born on the image bearing member into a toner image by using the developer in the developing container; a transfer member configured to transfer the toner image born on the image bearing member onto the recording material; and a notification portion configured to notify replenishment information for prompting replenishing the developing container with the developer, wherein, in a case where the developing container is replenished with the developer after the notification portion notifies the replenishment information of a previous time when an amount of the developer in the developing container is smaller than a first amount, the notification portion notifies the replenishment information of a next time when the amount of the developer in the developing container is smaller than a second amount larger than the first amount.

According to still another aspect of the invention, an image forming apparatus is configured to form an image on a recording material, the image forming apparatus including: a rotatable image bearing member configured to bear an electrostatic latent image; a developing container configured to accommodate developer including toner; a developing member configured to develop the electrostatic latent image born on the image bearing member into a toner image by using the developer in the developing container; a transfer member configured to transfer the toner image born on the image bearing member onto the recording material; and a notification portion configured to notify replenishment information for prompting replenishing the developing container with the developer, wherein, in a case of forming an image on a recording material of a first kind in an initial state in which a predetermined amount of the developer is accommodated in the developing container and paper dust is not mixed in the developer in the developing container, the notification portion notifies the replenishment information in a case where an accumulated number of sheets of the recording material of the first kind on which images have been formed has exceeded a first number of sheets, and wherein, in a case of forming an image on a recording material of a second kind different from the recording material of the first kind in the initial state, the notification portion notifies the replenishment information in a case where an accumulated number of sheets of the recording material of the second kind on which images have been formed has exceeded a second number of sheets larger than the first number of sheets.

Further features of the present invention will become apparent from the following description of exemplary embodiments with reference to the attached drawings.

DESCRIPTION OF THE EMBODIMENTS

Exemplary embodiments of the present invention will be described below with reference to drawings.

First Exemplary Embodiment

Figure 1A:
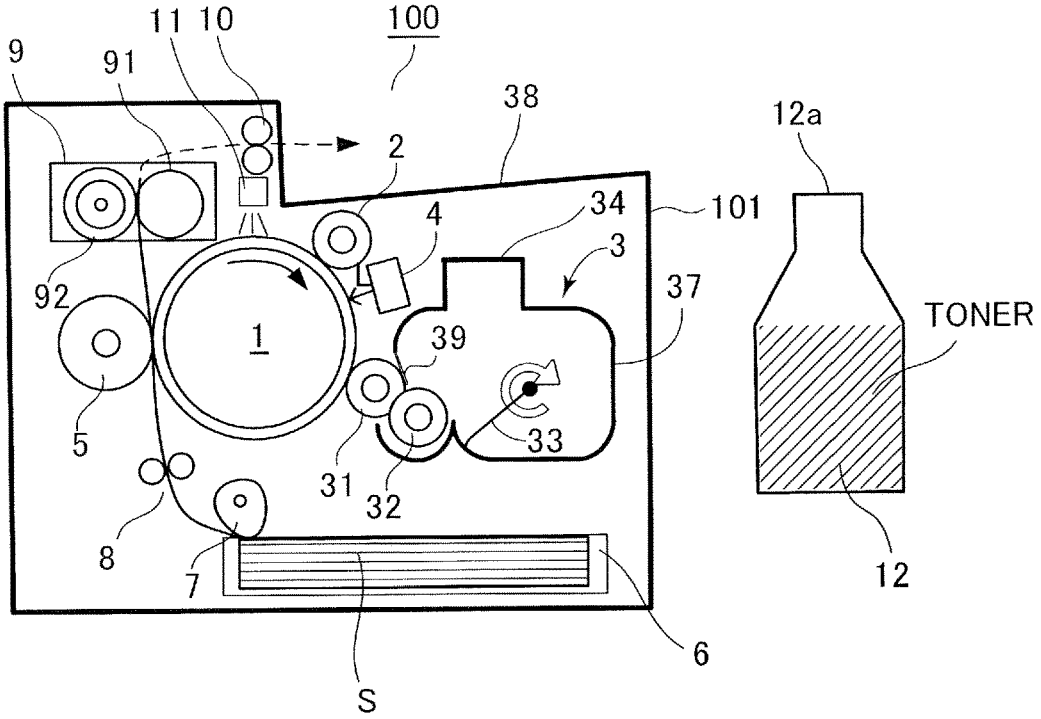
FIGS. 1A and 1B are each a schematic view of an image forming apparatus according to a first exemplary embodiment.

FIG. 1A is a schematic diagram illustrating a configuration of an image forming apparatus 100 according to a first exemplary embodiment. The image forming apparatus 100 is a monochromatic printer that forms an image on a recording material on the basis of image information input from an external apparatus. Examples of the recording material include sheets of different materials. Examples of the sheets of different materials include paper sheets such as regular paper sheets and cardboards, plastic films such as sheets for overhead projectors, sheets of irregular shapes such as envelops and index sheets, and cloths.

An apparatus body 101 of the image forming apparatus 100 includes an electrophotographic unit of a direct transfer system. That is, the apparatus body 101 includes a developing apparatus 3, a transfer roller 5, and a pre-exposing unit 11. The developing apparatus 3 includes a photosensitive drum 1, a charging roller 2 disposed in the vicinity of the photosensitive drum 1, an exposing unit 4, and a developing roller 31. The photosensitive drum 1 is an image bearing member of the present exemplary embodiment, the charging roller 2 is a charging member of the present exemplary embodiment, the exposing unit 4 is a exposing unit of the present exemplary embodiment, the developing roller 31 is a developing member of the present exemplary embodiment, and the transfer roller 5 is a transfer member of the present exemplary embodiment.

The photosensitive drum 1 is a photosensitive member formed in a cylindrical shape. The photosensitive drum 1 of the present exemplary embodiment includes a drum-shaped base body formed from aluminum, and a photosensitive layer formed from a negatively-chargeable organic photoconductor thereon. In addition, the photosensitive drum 1 is rotationally driven in a predetermined direction at a predetermined peripheral speed by a driving motor. In the present exemplary embodiment, the predetermined direction is a clockwise direction in FIGS. 1A and 1B. The peripheral speed of the photosensitive drum 1 defines the speed of image formation performed by the image forming apparatus 100, and is therefore also referred to as a process speed.

The charging roller 2 is in contact with the photosensitive drum 1 by a predetermined pressure contact force to form a charging portion. In addition, a desired charging voltage is applied to the charging roller 2 by a charging high-voltage power source, and thus the charging roller 2 uniformly charges the surface of the photosensitive drum 1 to a predetermined potential. In the present exemplary embodiment, the photosensitive drum 1 is negatively charged by the charging roller 2.

The exposing unit 4 of the present exemplary embodiment is a laser scanner unit. That is, the exposing unit 4 exposes the surface of the photosensitive drum 1 in a scanning manner by irradiating the photosensitive drum 1 with laser light corresponding to the image information input from the external apparatus by using a polygon mirror. As a result of this exposure, an electrostatic latent image corresponding to the image information is formed on the surface of the photosensitive drum 1. To be noted, the exposing unit 4 is not limited to a laser scanner unit, and for example, a light-emitting diode: LED exposing unit including an LED array in which a plurality of LEDs are arranged along the longitudinal direction of the photosensitive drum 1 may be employed.

The developing apparatus 3 includes a developing container 37 serving as a frame member of the developing apparatus 3, the developing roller 31 serving as a developer bearing member, and a supply roller 32 serving as a supply member that supplies developer to the developer bearing member. A developer accommodating chamber that accommodates toner serving as developer of the present exemplary embodiment is formed in the developing container 37. The developing roller 31 and the supply roller 32 are rotatably supported by the developing container 37. In addition, the developing roller 31 is disposed in an opening portion of the developing container 37 so as to oppose the photosensitive drum 1. The supply roller 32 is rotatably in contact with the developing roller 31, and the toner accommodated in the developing container 37 is applied on the surface of the developing roller 31 by the supply roller 32.

In the developing apparatus 3, a contact developing system is used as the developing system. That is, a toner layer born on the developing roller 31 comes into contact with the photosensitive drum 1 in a developing portion, that is, a developing region where the photosensitive drum 1 and the developing roller 31 face each other. A developing voltage is applied to the developing roller 31 by a developing high-voltage power source. The toner born on the developing roller 31 is transferred from the developing roller 31 onto the surface of the photosensitive drum 1 in accordance with the potential distribution of the surface of the photosensitive drum 1 under the developing voltage, and thus the electrostatic latent image is developed into a toner image. To be noted, in the present exemplary embodiment, a reversal development system is employed. That is, toner attaches to a surface region of the photosensitive drum 1 where the amount of charges is reduced by being exposed in an exposing step after being charged in a charging step, and thus a toner image is formed.

In the present exemplary embodiment, a regular toner having a particle diameter of 6 μm whose normal charging polarity is a negative polarity is used. For example, a polymer toner manufactured by a polymerization method is used as the toner of the present exemplary embodiment. In addition, the toner of the present exemplary embodiment is so-called nonmagnetic one-component developer that does not contain a magnetic component, and is born on the developing roller 31 mainly by an intermolecular force or an electrostatic force, in other words, an image force. However, a one-component developer containing a magnetic component may be used. In some cases, the one-component developer contains an additive for adjusting the fluidity or charging performance of the toner is contained in addition to the toner particles. Examples of the additive include wax and silica fine particles. In addition, a two-component developer constituted by nonmagnetic toner and magnetic carrier may be used as the developer. In the case of using a magnetic developer, for example, a tubular developing sleeve on an inner surface of which a magnet is disposed is used as a developer bearing member.

Figure 1B:
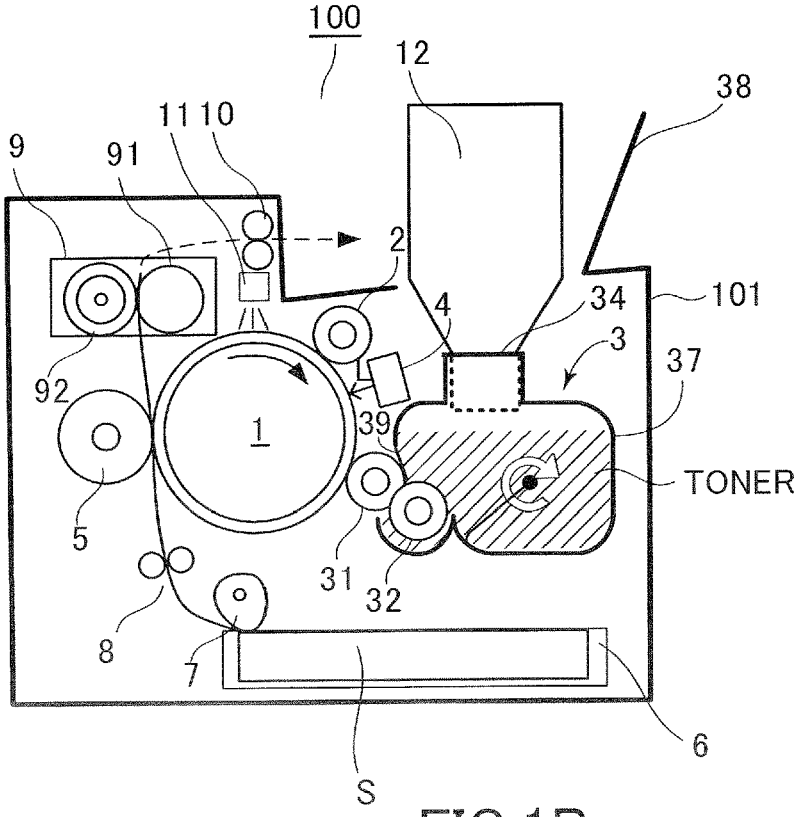

An agitation blade 33 serving as an agitation member is provided inside the developing container 37. The agitation blade 33 pivots to agitate the toner and deliver the toner to the developing roller 31 and the supply roller 32 by being driven by a driving motor. As illustrated in FIGS. 1A and 1B, the agitation blade 33 rotates in a clockwise direction in FIGS. 1A and 1B about a rotation shaft. In addition, the agitation blade 33 has a function of circulating, in the developing container 37, toner that has not been used for development and has been peeled off from the developing roller 31, and thus uniformizing the toner in the developing container 37.

In addition, a developing blade 39 serving as a regulation member that regulates the amount of developer born on the developer bearing member is disposed in the opening portion of the developing container 37 in which the developing roller 31 is disposed. The toner supplied to the surface of the developing roller 31 is uniformly flattened into a thin layer and is negatively charged by frictional charging, by passing through a portion where the developing roller 31 and the developing blade 39 face each other in accordance with the rotation of the developing roller 31.

In the present exemplary embodiment, the developing roller 31 is formed by forming a base layer of silicone rubber on a conductive core metal and a surface layer of urethane rubber thereon. To be noted, the volume resistivity of the developing roller 31 may be $10^4\Omega$ or higher and $10^{13}\Omega$ or lower. In addition, in the present exemplary embodiment, the developing blade 39 is an SUS (stainless steel) metal plate having a thickness of 0.1 mm.

To be noted, the amount of charges of the toner per unit weight by frictional charging can be increased by increasing the contact pressure between the developing roller 31 and the developing blade 39. This amount will be hereinafter referred to as a toner charge amount. By increasing the toner charge amount, a state in which the toner is likely to be transferred from the developing roller 31 onto the photosensitive drum 1 by the potential difference between an exposed portion of the photosensitive drum 1 and the developing roller 31 is realized. To be noted, in the case where the contact pressure is too high, the toner charge amount becomes too large in a low-temperature and low-humidity environment, and thus there is a possibility that the image density becomes low. In the case where the toner charge amount is too large, the potential difference between the exposed portion and an unexposed portion on the surface of the photosensitive drum 1 is filled up with only a small amount of toner, and thus the density of the developed toner image becomes insufficient. Therefore, the contact pressure, that is, pressurizing force per unit length in the longitudinal direction, of the developing blade 39 is preferably from 10 gf/cm to 100 gf/cm. In the present exemplary embodiment, the contact pressure between the developing roller 31 and the developing blade 39 is set to 30 gf/cm.

The transfer roller 5 may be preferably constituted by an elastic member such as a sponge rubber formed from polyurethane rubber, ethylene propylene diene monomer rubber: EPDM rubber, nitrile butadiene rubber: NBR, or the like. In the present exemplary embodiment, a nickel-plated steel rod having a diameter of 5 mm and covered by a foam sponge of NBR whose resistance is adjusted to $5\times10^7\Omega$ is used as the transfer roller 5. The resistance can be adjusted by mixing a conductive material such as hydrin or carbon in the NBR. The outer diameter of the foam sponge is 13 mm. The width of the foam sponge in a direction perpendicular to the conveyance direction of the recording material, that is, in the longitudinal direction of the transfer roller 5, is set to 216 mm, assuming a Letter size as the maximum size of a recording material on which an image can be formed by the image forming apparatus 100.

The transfer roller 5 is pressed against the photosensitive drum 1, and forms a transfer portion where the photosensitive drum 1 and the transfer roller 5 are in pressure contact. While conveyance deviation and transfer deviation become less likely to occur and higher image quality can be achieved in the case where the pressing force between the photosensitive drum 1 and the transfer roller 5 is higher, image defects derived from transfer omission becomes likely to occur in the case where the pressing force is too high. The pressing force between the photosensitive drum 1 and the transfer roller 5 is, for example, preferably 4.9 N to 24.5 N, that is, 500 gf to 2500 gf. In the present exemplary embodiment, the pressing force is set to 9.8 N, that is, 1000 gf. In addition, in the conveyance direction of the recording material, the width of a nip region where the photosensitive drum 1 and the transfer roller 5 are in contact with each other in the transfer portion is about 1 mm.

Recording materials S accommodated in a cassette 6 are fed one by one by a feeding unit 7 at a timing matching the toner image formed on the photosensitive drum 1 reaching the transfer portion, and the fed recording material S is conveyed to the transfer portion through a registration roller pair 8. In addition, a transfer voltage is applied from a transfer high-voltage power source to the transfer roller 5 at a timing when the toner image formed on the photosensitive drum 1 reaches the transfer portion. As a result of this, the toner image born on the photosensitive drum 1 is transferred onto the recording material passing through the transfer portion.

The recording material S onto which the toner image has been transferred is conveyed to a fixing unit 9. The fixing unit 9 is of a thermal fixation type that performs a process of fixing an image by heating and thus melting the toner on the recording material. The fixing unit 9 of the present exemplary embodiment includes a fixing film 91, a fixing heater such as a ceramic heater that heats the fixing film 91, a thermistor that measures the temperature of the fixing heater, and a pressurizing roller 92 that comes into pressure contact with the fixing film 91. The toner image is heated and pressurized when the recording material S passes through a nip portion between the fixing film 91 and the pressurizing roller 92. As a result of this, the toner particles melt and then adhere to the recording material S, and thus the image is fixed to the recording material S. The recording material S that has passed through the fixing unit 9 is discharged to the outside of the image forming apparatus 100 by a discharge roller pair 10. Examples of other heating mechanisms for heating a fixing member such as the fixing film 91 in a thermal fixation system include halogen lamps and induction heating systems.

In addition, the image forming apparatus 100 includes the pre-exposing unit 11 serving as a charge removing unit that performs charge removing processing on the photosensitive drum 1 is provided downstream of the transfer portion and upstream of the charging portion in the rotation direction of the photosensitive drum 1. The pre-exposing unit 11 eliminates the surface potential of the photosensitive drum 1 at a position before entering the charging portion, to cause stable electrical discharge in the charging portion.

Figure 2:
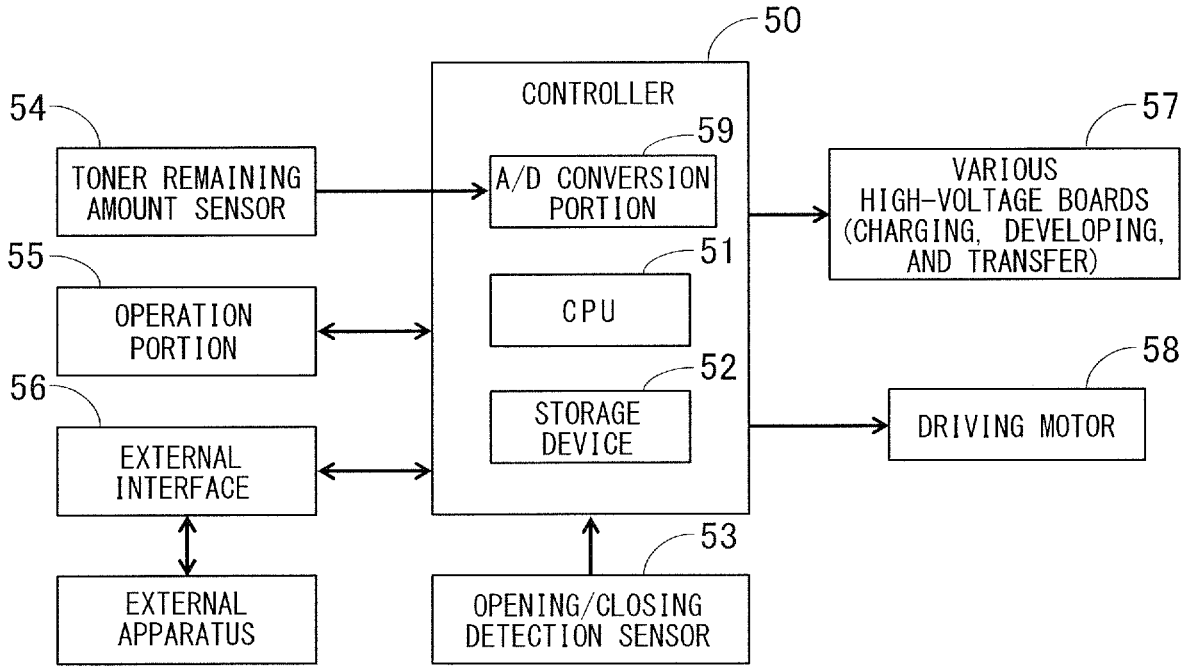
FIG. 2 is a block diagram illustrating a control configuration of the image forming apparatus according to the first exemplary embodiment.

FIG. 2 is a block diagram illustrating a control system of the image forming apparatus 100. The image forming apparatus 100 includes, as a controller that controls the operation of the apparatus, a controller 50 including a central processing unit: CPU 51, a storage device 52 including a nonvolatile storage area and a volatile storage area, and am analog/digital conversion portion: A/D conversion portion 59. The CPU 51 loads and executes a control program stored in the storage device 52, and thus operates various high-voltage boards, the driving motor 58, and so forth to perform the image forming operation described above. Examples of the various high-voltage boards include the charging high-voltage power source, the developing high-voltage power source, and the transfer high-voltage power source. To be noted, the driving motor 58 of the present exemplary embodiment is a shared drive source that drives at least the photosensitive drum 1, the developing roller 31, the supply roller 32, the agitation blade 33, and the feeding unit 7. In addition, the storage device 52 serves as an example of a non-transitory computer-readable storage medium storing a control program for causing the image forming apparatus 100 to perform a predetermined method.

The controller 50 is connected to an operation portion 55 serving as a user interface of the image forming apparatus 100. The operation portion 55 includes a display apparatus such as a liquid crystal panel, and an input device such as a mechanical key or a touch panel of the liquid crystal panel. The controller 50 conveys information to the user through the operation portion 55, and receives input of information, for example, setting of conditions such as image density, from the user. the information conveyed to the user through the operation portion 55 includes toner replenishment notification for prompting the user to replenish toner.

In addition, the controller 50 is electrically connected to a toner remaining amount sensor 54 and an opening/closing detection sensor 53, and receives signals output from these sensors. Particularly, an analog signal output from the toner remaining amount sensor 54 is digitalized by the A/D conversion portion 59 and analyzed by the CPU 51. The toner remaining amount sensor 54 and the opening/closing detection sensor 53 will be described later. In addition, the controller 50 is connected to an external apparatus through an external interface: external IF 56, and is thus capable of mutually communicating data with the external apparatus. Examples of the external apparatus include a personal computer: PC in which driver software corresponding to the image forming apparatus 100 is installed, and in this case, the user can instruct execution of printing to the image forming apparatus 100 by an operation input through the screen of the PC.

Collection of Transfer Residual Toner

Transfer residual toner remaining on the photosensitive drum 1 without being transferred onto the recording material S is removed by the following procedure. The transfer residual toner contains positively charged toner and toner that is negatively charged but does not have enough charges. By removing charges on the photosensitive drum 1 by the pre-exposing unit 11 after transfer and causing uniform electrical discharge from the charging roller 2, the transfer residual toner is negatively charged again. The transfer residual toner negatively charged again at the charging portion reaches an exposing portion in accordance with the rotation of the photosensitive drum 1. Then, the surface region of the photosensitive drum 1 having passed through the charging portion is exposed by the exposing unit 4 in the state in which the transfer residual toner is still attached to the surface, and thus an electrostatic latent image is drawn in the surface region.

Here, description of behavior of the transfer residual toner that has reached the developing portion will be given for the exposed portion and the unexposed portion of the photosensitive drum 1, respectively. The transfer residual toner attached to the unexposed portion of the photosensitive drum 1 is transferred onto the developing roller 31 due to the potential difference between the potential of the unexposed portion of the photosensitive drum 1, that is, dark potential, and the developing voltage in the developing portion, and is collected into the developing container 37. This is because, assuming that the normal charging polarity of the toner is a negative polarity, the developing voltage applied to the developing roller 31 is relatively positive with respect to the potential of the exposed portion. To be noted, the toner collected into the developing container 37 is agitated with and dispersed in the toner in the developing container 37 by the agitation blade 33, and is born on the developing roller 31 to be used again in a developing step.

Meanwhile, the transfer residual toner attached to the exposed portion of the photosensitive drum 1 remains on the surface of the photosensitive drum 1 without being transferred from the photosensitive drum 1 onto the developing roller 31 in the developing portion. This is because, assuming that the normal charging polarity of the toner is a negative polarity, the developing voltage applied to the developing roller 31 is further negative with respect to the potential of the exposed portion, that is, light potential. The transfer residual toner remaining on the surface of the photosensitive drum 1 moves to the transfer portion by being born on the photosensitive drum 1 together with other toner transferred from the developing roller 31 to the exposed portion, and is thus transferred onto the recording material S in the transfer portion.

As described above, although a cleanerless configuration in which the transfer residual toner is collected into the developing apparatus 3 and reused is employed in the present exemplary embodiment, a conventionally known configuration in which the transfer residual toner is collected by using a cleaning blade abutting the photosensitive drum 1 may be employed. In this case, the transfer residual toner collected by the cleaning blade is collected into a collection container provided in addition to the developing apparatus 3. A control method for toner replenishment that will be described later is also applicable to such a configuration in which the transfer residual toner is not collected into the developing apparatus 3 to be reused. However, by employing the cleanerless configuration, a space for installing a collection container for collecting the transfer residual toner and the like does not have to be provided, which enables further miniaturization of the image forming apparatus 100, and the printing cost can be also reduced by reusing the transfer residual toner.

Supply of Developer to Developing Apparatus

Next, a method of replenishing the image forming apparatus 100 with developer will be described. In the present exemplary embodiment, a direct replenishment system in which the user repetitively supplies developer to the developing apparatus 3 from a container filled with developer for replenishment in a state in which the developing apparatus 3 is attached to the image forming apparatus 100 is employed.

As illustrated in FIG. 1A, an opening portion 34 for receiving toner from a toner bottle 12 serving as an example of a supply container is provided in the developing container 37. The opening portion 34 is configured such that a supply port 12*a* of the toner bottle 12 can be attached to and detached from the opening portion 34. In a state in which a cover 38 provided on an upper surface of the apparatus body 101 is closed, the opening portion 34 is covered by the cover 38. Although the cover 38 serving as an opening/closing member is pivotable with respect to the apparatus body 101 about a hinge provided in an end portion on the right side in FIG. 1A, for example, an opening/closing member of a sliding type may be used, or a double door in which a hinge is provided on each of opposing sides of the opening may be used.

As illustrated in FIG. 1B, when the cover 38 is opened, the opening portion 34 is exposed, and it becomes possible to attach the toner bottle 12 to the developing apparatus 3 from above. When the toner bottle 12 is attached and the supply port 12*a* and the opening portion 34 are connected, toner in the toner bottle 12 falls due to its own weight and moves to the developing container 37. As a result of this, toner is supplied from the toner bottle 12 to the developing apparatus 3. By placing a connecting portion between the supply port 12*a* of the toner bottle 12 and the opening portion 34 of the developing apparatus 3 inside the apparatus body 101, scattering of toner to the surroundings of the image forming apparatus 100 when replenishing toner by the direct replenishment system can be reduced.

Figure 5A:
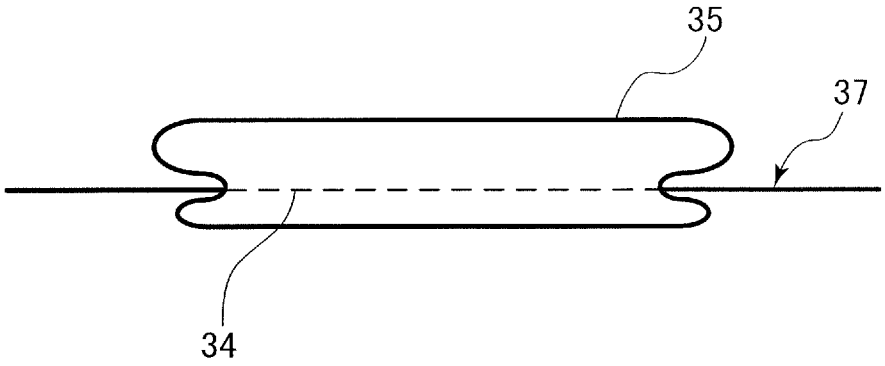
FIGS. 5A to 5C are diagrams illustrating a cap attached to the developing apparatus and the toner bottle according to the first exemplary embodiment.
Figure 5B:
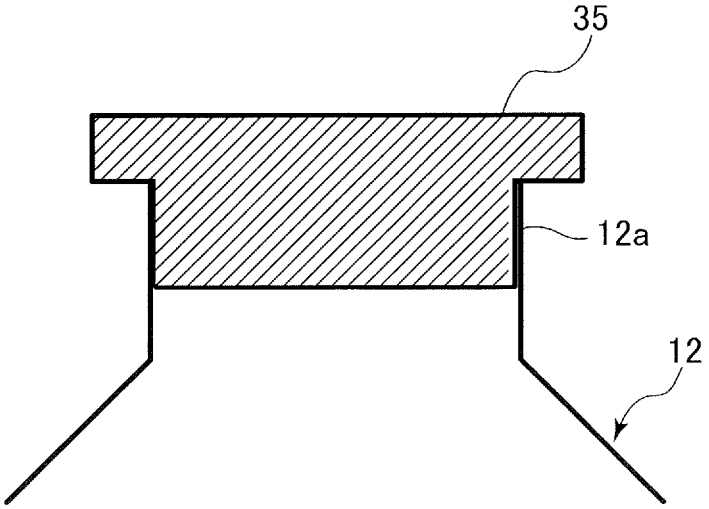
Figure 5C:
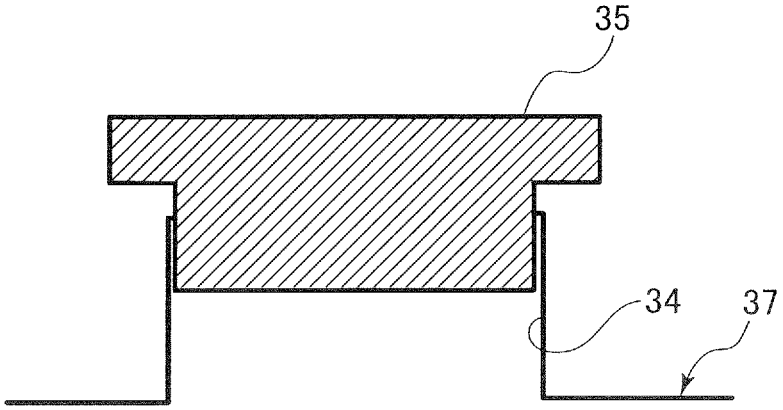

Then, when the opening/closing detection sensor 53 illustrated in FIG. 2 detects that the cover 38 is closed, it becomes possible to start driving the agitation blade 33 and the developing roller 31, and the toner remaining amount is detected as will be described later. After the toner bottle 12 is detached from the image forming apparatus 100 after replenishing toner, a cap 35 illustrated in FIGS. 5A to 5C is attached to the supply port 12*a* of the toner bottle 12 and the opening portion 34 of the developing apparatus 3. As a result of this, leakage of toner from the developing apparatus 3 during image formation and from the toner bottle 12 detached from the image forming apparatus 100 can be prevented.

The image forming apparatus 100 has a function of, in the case where the developing apparatus 3 needs to be replenished with toner, notifying information prompting the user to perform toner replenishment and stopping the image forming operation. In this case, as illustrated in FIG. 1A, it is preferable that the agitation blade 33 is stopped in an inclined state such that the toner falling from above is guided to the developing roller 31 and the supply roller 32 by the agitation blade 33. In this manner, by using the agitation blade 33 as a toner guiding member, toner can be supplied to the developing roller 31 more quickly.

To be noted, employing a successive replenishment system in which a toner bottle is mounted in the image forming apparatus 100 and toner supplied from the toner bottle is supplied to the developing apparatus 3 little by little by a hopper apparatus instead of the direct replenishment system can be also considered. A hopper apparatus is an apparatus that temporarily reserves the toner discharged from the toner bottle 12 and supplies the toner to the inside of the developing apparatus 3 by using a toner conveyance member such as a screw.

However, in the successive replenishment system, a space serving as a conveyance path for the toner from the toner bottle to the developing apparatus 3 and a drive source and a drive transmission mechanism for driving the toner conveyance member are required, which leads to increase in the size of the apparatus. In addition, in the successive replenishment system, a waiting time in which the image forming apparatus 100 cannot output an image may occur after replacing the toner bottle due to a delay until toner supplied from the replaced toner bottle actually reaches the developing apparatus 3. The direct replenishment system of the present exemplary embodiment has an advantage that the apparatus can be further miniaturized because the conveyance path for the toner is not needed, and the delay until the image forming apparatus 100 resumes image output after the operation of replenishing toner can be shortened.

In addition, as illustrated in FIGS. 1A and 1B, the toner bottle 12 is attachable to and detachable from the image forming apparatus 100, and the image forming operation is performed in a state in which the toner bottle 12 is detached. By employing such a configuration, a space for keeping the toner bottle 12 in the image forming apparatus 100 is not needed, and thus it is possible to further miniaturize the image forming apparatus 100.

Figure 18A:
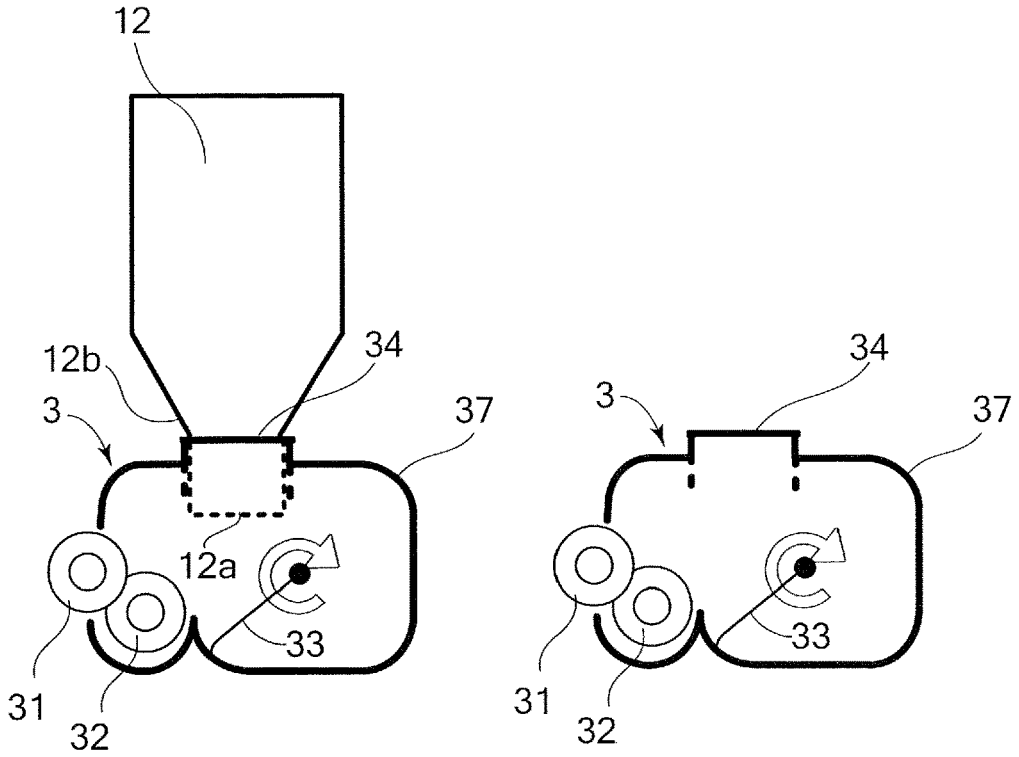
FIGS. 18A and 18B are diagrams illustrating modification examples of shapes of the developing apparatus and the toner bottle.

To be noted, the shapes of the supply port 12*a* of the toner bottle 12 and the opening portion 34 of the developing apparatus 3 are not limited to the shapes illustrated in FIGS. 1A and 1B as long as the supply port 12*a* can be connected to and detached from the opening portion 34. For example, in FIG. 18A, the opening portion 34 projects upward from the upper surface of the developing container 37. In addition, the inner wall of the opening portion 34 extends below the upper surface of the developing container 37 toward the inside of the developing container 37. This is indicated by a dotted line on the right side of FIG. 18A. The toner bottle 12 is guided downward as a result of the outer wall of the supply port 12*a* coming into contact with the inner wall of the opening portion 34, and downward movement of the toner bottle 12 is restricted by as a result of a bottle side surface 12*b* whose outer diameter is larger than that of the supply port 12*a* coming into contact with the edge of the opening portion 34.

Figure 18B:
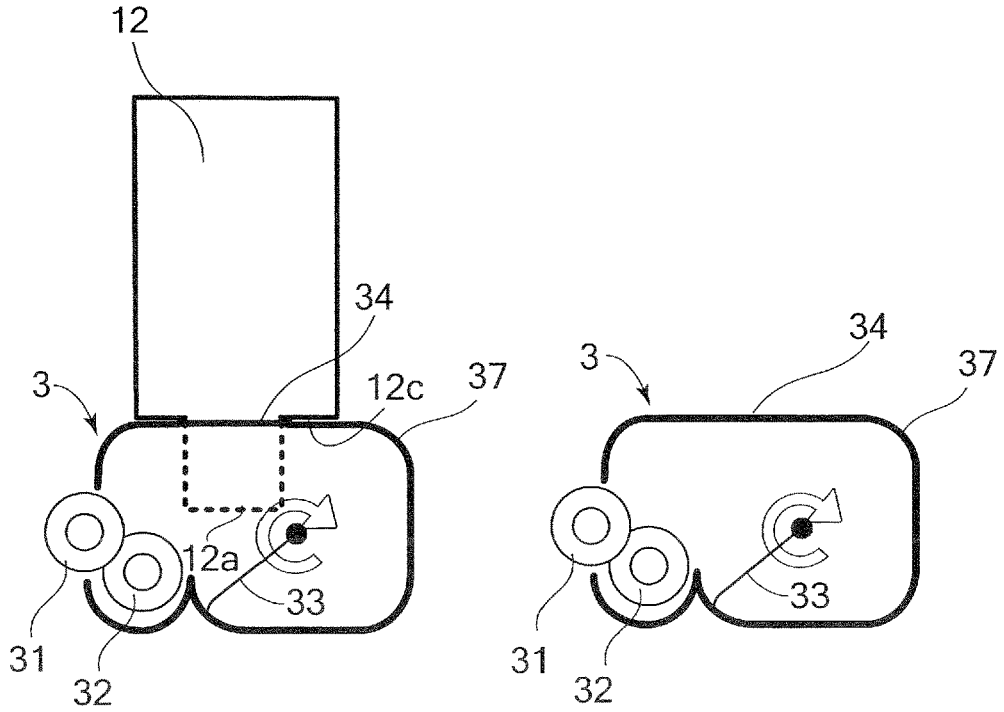

In addition, as illustrated in FIG. 18B, the toner bottle 12 may have an abutting surface 12*c* that abuts the developing container 37, and the downward movement of the toner bottle 12 may be restricted by the abutting surface 12*c* abutting the upper surface of the developing container 37.

Accommodated Developer Amount of Toner Bottle

The amount of toner accommodated in the toner bottle 12 will be described. Although the amount of toner accommodated in the toner bottle 12 may be appropriately selected, in the present exemplary embodiment, the amount of toner accommodated in the toner bottle 12 is preferably from A g to B g. Here, A g is such a toner amount that the toner is accommodated in a region below a horizontal plane including the highest point of the developing roller 31 in the vertical direction in the inner space of the developing container 37 in an orientation of the developing apparatus 3 during image formation. That is, A g is the minimum amount of toner with which the developing roller 31 is covered by replenished toner in the case where toner replenishment is performed in a state in which the developing container 37 is empty.

In addition, B g is a difference between the maximum amount of toner that can be accommodated in the developing container 37 and the toner remaining amount at which the toner replenishment notification is performed. Therefore, in the case where the amount of toner accommodated in the toner bottle 12 is set to a value of A g to B g, all toner accommodated in the toner bottle 12 can be moved to the developing container 37 when the user performs the toner replenishment operation in accordance with the toner replenishment notification.

Figure 4:
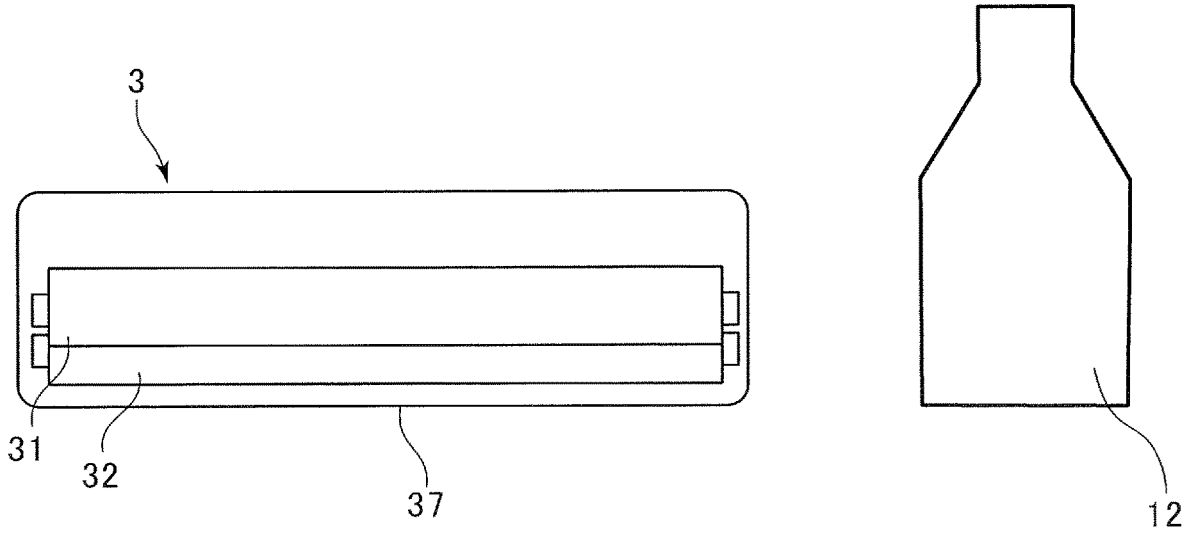
FIG. 4 is a diagram for comparing a developing apparatus and a toner bottle according to the first exemplary embodiment.

FIG. 4 illustrates a relationship between the developing apparatus 3 and the toner bottle 12 as viewed in a direction perpendicular to the longitudinal direction of the developing roller 31. As illustrated, the developing container 37 extends in the longitudinal direction, and has a capacity large enough to receive all toner sealed in the toner bottle 12.

Method for Detecting Toner Remaining Amount

Next, a method for detecting the toner remaining amount in the developing apparatus 3 will be described with reference to FIGS. 3A to 3C. To be noted, the toner remaining amount detected herein does not have to be the weight of the toner itself remaining in the developing apparatus 3. The toner remaining amount may be information indicating the weight of the toner or a signal indicating a state that changes in accordance with the toner remaining amount as long as the information can be used by the CPU 51. The developing apparatus 3 of the present exemplary embodiment includes a toner remaining amount sensor 54 of an optical type as a detection portion for detecting the amount of developer remaining in the developing container. The remaining amount information detected by the toner remaining amount sensor 54 can be also referred to as a signal indicating a state that changes in accordance with the toner remaining amount.

The toner remaining amount sensor 54 is constituted by a light emitting portion 22 and a light receiving portion 23 disposed in the developing container 37. The light emitting portion 22 emits light toward the light receiving portion 23 via an optical path R passing through the inside of the developing container 37. The light receiving portion 23 outputs a signal on the basis of whether or not light from the light emitting portion 22 is detected.

When the agitation blade 33 rotates, toner struck up by the agitation blade 33 blocks the optical path R, and thus the signal output from the light receiving portion 23 changes. FIG. 3A illustrates a state in which the optical path R is not blocked by the toner, and the light receiving portion 23 detects the light from the light emitting portion 22 in this state.

Figure 3A:
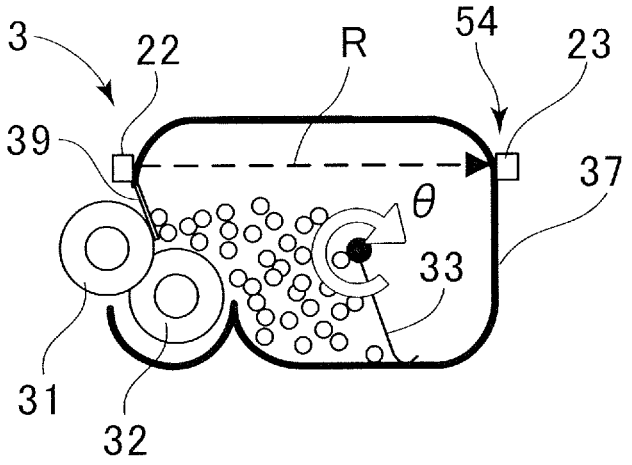
FIGS. 3A to 3C are diagrams for describing a toner remaining amount sensor in the first exemplary embodiment.
Figure 3B:
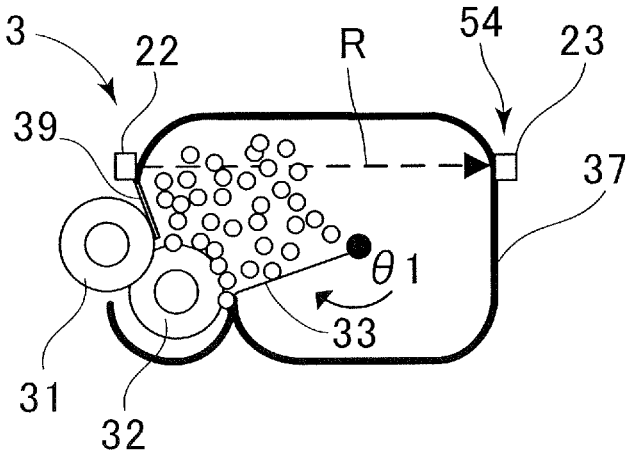

FIG. 3B illustrates a state in which the agitation blade 33 has rotated by an angle θ1 from the state illustrated in FIG. 3A. The agitation blade 33 presses the toner in the developing container 37 toward the developing roller 31 and pushes up the toner toward an upper portion of the developing container 37. In this state, the optical path R is blocked by part of the toner, and thus the light receiving portion 23 does not detect the light from the light emitting portion 22.

Figure 3C:
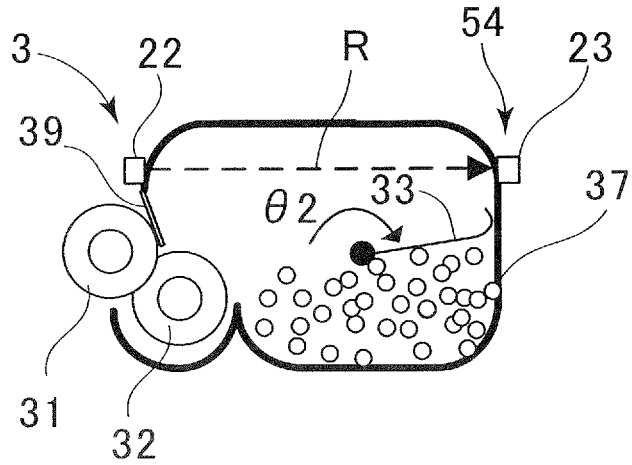

FIG. 3C illustrates a state in which the agitation blade 33 has rotated by an angle θ2 from the state illustrated in FIG. 3B. Since the toner has fallen to the bottom portion of the developing container 37 due to its own weight and the optical path R is not blocked by the toner or the agitation blade 33, the light receiving portion 23 detects the light from the light emitting portion 22. In the case where the agitation blade 33 further rotates in an arrow 0 direction in this state, the state transitions to the state illustrated in FIG. 3A.

In this manner, a period in which the light receiving portion 23 does not detect the light from the light emitting portion 22 and a period in which the light receiving portion 23 detects the light are included in one rotation of the agitation blade 33. In addition, even in the case where the light receiving portion 23 detects the light, the received light intensity changes depending on the situation. The length of the period in which the light receiving portion 23 detects the light from the light emitting portion 22, that is, light transmission time, and the intensity of the light received by the light receiving portion 23, that is, the light amount, change depending on the amount of toner remaining in the developing container 37. That is, in the case where the toner remaining amount is large, the optical path R is easily blocked by the toner, and therefore the light transmission time is short and the intensity of the received light is low. Conversely, in the case where the toner remaining amount is small, the light transmission time is long and the intensity of the received light is high. Therefore, the CPU 51 detects the toner remaining amount in the developing apparatus 3 as, for example, a value in a range of 0% to 100% by setting the maximum amount of toner that can be accommodated in the developing container 37 as 100%, by obtaining the signal output from the toner remaining amount sensor 54 through the A/D conversion portion 59 and analyzing the change in the light transmission time, the received light intensity, and the change in the received light intensity. Specifically, the CPU 51 specifies the toner remaining amount by referring to a table in which toner remaining amount information is assigned to each light transmission time and each received light intensity.

To be noted, the method for detecting/estimating the toner remaining amount is not limited to the method described with reference to FIGS. 3A to 3C, and various known methods for detecting/estimating the toner remaining amount can be employed. For example, the toner remaining amount may be detected/estimated by disposing two or more metal plates or conductive resin sheets extending in the longitudinal direction of the developing roller 31 on the inner wall of the developing container 37 serving as a frame member and measuring the capacitance between two metal plates or conductive resin sheets. Alternatively, a load cell may be provided to support the developing apparatus 3 from below, and the CPU 51 may calculate the toner remaining amount by subtracting the weight of the developing apparatus 3 including no toner from the weight measured by the load cell.

Toner Replenishment Notification

When the amount of developer remaining in the developing container 37 becomes small, the image forming apparatus 100 performs toner replenishment notification of notifying the user of information prompting toner replenishment, that is, replenishment information. The controller 50 having the function of performing the toner replenishment notification serves as a notification portion of the present exemplary embodiment. For example, as a method for notification, a message indicating that the toner needs to be replenished may be displayed on a display apparatus such as a liquid crystal display. In addition, the notification may be performed by using a sound through a loudspeaker, or may be performed by lighting or flickering a light emitting diode lamp: LED lamp. The toner replenishment notification may be performed by using an operation portion 55 provided in the image forming apparatus 100 as a medium for toner replenishment notification, or may be performed by using an external apparatus illustrated in FIG. 2 connected to the image forming apparatus 100 via the external I/F 56 as a medium for toner replenishment notification, by transmitting data to the external apparatus. Examples of the external apparatus include a personal computer. In addition, the communication with the external apparatus via the external I/F 56 may be performed wirelessly or in a wired manner.

Maintenance of Operation Stopped State

The image forming apparatus 100 includes the opening/closing detection sensor 53 illustrated in FIG. 2 that detects a state in which the cover 38 is open. As the opening/closing detection sensor 53, an optical sensor or a mechanical sensor can be used. In the case where a signal indicating the state in which the cover 38 is open is input from the opening/closing detection sensor 53, the controller 50 does not allow the image forming apparatus 100 to perform the image forming operation. That is, the controller 50 does not allow driving the photosensitive drum 1 and so forth to form an image on a recording material even in the case where a print job is input from the outside. In addition, the attachment state of the toner bottle 12 may be detected instead of detecting the state in which the cover 38 is open. That is, in the case where it is detected by an unillustrated sensor that the toner bottle 12 is attached to the opening portion 34, the controller 50 similarly does not allow the image forming operation.

As described above, the configuration described in the present exemplary embodiment enables providing a mechanism with which toner replenishment of higher usability can be performed. Specifically, for example, after toner replenishment is performed, image formation can be resumed quickly, and the downtime can be reduced. In addition, for example, the size of the image forming apparatus can be reduced because a complex toner conveyance path or the like is not needed, and thus the cost can be reduced. Further, for example, problems such as toner scattering that are likely to occur in an image forming apparatus of a toner replenishment type can be prevented.

Occurrence of Background Fogging Due to Paper Dust

Here, mechanism of occurrence of background fogging due to accumulation of paper dust in the developing apparatus will be described. In the case where the image forming apparatus forms an image on a recording material, paper dust of filler, additives, fibers, and the like contained in the recording material of paper is generated, and the paper dust attaches to the photosensitive drum 1 in the transfer portion. Part of this paper dust reaches the developing portion in accordance with the rotation of the photosensitive drum 1, and after being transferred from the photosensitive drum 1 onto the developing roller 31, the paper dust is collected into the developing container 37 by, for example, being scraped off by the supply roller 32. The paper dust that enters the developing container 37 through this path is partially discharged to the outside of the developing apparatus 3 via the developing roller 31, but is gradually accumulated in the developing container 37 as a result of repetitively performing image formation on the recording material.

In the paper dust, talc used as filler of paper is easily negatively chargeable. In other words, talc has a characteristic of being likely to positively charge another material. Talc has a chemical composition of $Mg_3(Si_4O_{10})(OH)_2$. In the present exemplary embodiment, toner whose normal charging polarity is a negative polarity is used, and when talc enters the developing container 37, the talc acts to positively charge the toner that is supposed to be negatively charged. Therefore, in the case where talc enters the developing container 37 and comes into contact with the toner, the toner charge amount is reduced.

The potential of the unexposed portion of the photosensitive drum 1 is set to be relatively negative with respect to the potential of the developing roller 31, and toner particles charged to the normal charging polarity normally do not attach to the unexposed portion. However, when the toner charge amount is reduced, the ratio of toner particles whose charge is insufficient and toner particles whose charging polarity has been reversed increases, and thus toner becomes more likely to attach also to the unexposed portion of the photosensitive drum 1. Then, when the toner attached to the unexposed portion is transferred onto the recording material S in the transfer portion, so-called "background fogging" in which a thin layer of toner is attached to also a region where an image is not supposed to be formed occurs, which leads to lower image quality.

In the case where the talc concentration in the developer, that is, the ratio of the amount of talc accumulated in the developing container 37 to the toner remaining amount in the developing container 37 is sufficiently low, there are not many opportunities for the toner to receive positive charges from talc, and therefore a desired toner charge amount can be maintained. However, as the talc concentration increases, the opportunities for the toner to receive positive charges from the talc increases, and it becomes difficult to maintain the toner charge amount, which leads to higher possibility of occurrence of background fogging.

Such background fogging caused by increase in the paper dust concentration in the developer can occur in a configuration including a cleaning blade that removes the transfer residual toner, and is more likely to occur in a cleanerless configuration like the present exemplary embodiment. In addition, such background fogging is more likely to occur in a high-temperature high-humidity environment in which the toner charge amount is relatively smaller than in a low-temperature low-humidity environment.

To be noted, the paper dust that causes decrease in the toner charge amount is not limited to talc. For example, calcium carbonate has a characteristic of being likely to be positively charged and negatively charge another material, and therefore, in the case where toner whose normal charging polarity is a positive polarity is used, calcium carbonate may cause decrease in the toner charge amount and thus cause background fogging. In the description below, talc used as filler of paper will be described as a typical example of paper dust that reduces the toner charge amount.

Threshold Value of Toner Remaining Amount for Toner Replenishment Notification

A method for the image forming apparatus to perform toner replenishment notification for prompting the user to replenish toner in the present exemplary embodiment will be described below. The image forming apparatus performs toner replenishment notification in the case where the toner remaining amount detected by the toner remaining amount sensor 54 is equal to or smaller than a predetermined value tlow. As described above, since background fogging becomes likely to occur when the paper dust concentration in the developer in the developing container 37 is high, the toner replenishment notification needs to be performed before the toner remaining amount in the developing container 37 is too small.

In the present exemplary embodiment, the value tlow of the toner remaining amount at which the toner replenishment notification is performed is set to a constant value. In the case where the value tlow of toner remaining amount at which the toner replenishment notification is performed is constant, the difference between tlow and the toner amount at which the developing container 37 is full, that is, the toner capacity of the developing container 37, is also always constant. Therefore, by preparing a toner bottle accommodating toner of an amount corresponding to the difference, the user can consume all toner in the opened toner bottle 12 every time. In the case where the toner bottle 12 is empty after replenishment, toner spilling and scattering when detaching the toner bottle 12 from the opening portion of the developing apparatus 3 is less likely to occur. This is advantageous because, for example, the configuration of the connecting portion between the toner bottle 12 and the developing apparatus 3 may be a simple configuration such as the configuration including the cap 35 illustrated in FIGS. 5A to 5C.

The value tlow of toner remaining amount at which the toner replenishment notification is performed needs to be set to such a value that background fogging is not caused by the paper dust accumulated in the developing container in the case of using the image forming apparatus for a long period while repetitively replenishing the developing apparatus 3 with toner. The inventors have studied a method for estimating a paper dust concentration C in the developing container 37 to obtain an appropriate value of tlow. The paper dust concentration C is the weight ratio of the paper dust accumulated in the developing container 37 to the toner remaining amount in the developing container 37.

Since the paper dust is generated in accordance with the image forming operation on the recording material, it can be considered that the amount of paper dust accumulated in the developing container 37 increases roughly proportionally to the accumulated number of sheets of the recording material on which images have been formed by the image forming apparatus. The accumulated number of sheets will be hereinafter referred to as a passed-through sheet number p. Meanwhile, in the case where the amount of paper dust present in the developing container 37 is constant, the paper dust concentration C is inversely proportional to the current toner remaining amount in the developing container 37. Therefore, the paper dust concentration C can be considered as a value proportional to a ratio of the passed-through sheet number p to a current toner remaining amount t, as expressed below. To be noted, "K sheets" of the number of passed-through sheets represents "thousand sheets".

$$C(p,t) \propto p[K \text{ sheets}]/t[\text{g}]$$

Therefore, in the present exemplary embodiment, the ratio of the passed-through sheet number p to the current toner remaining amount t is defined as a paper dust concentration index c indicating the paper dust concentration C in the developing container 37, as expressed below. The paper dust concentration index c is an example of an index correlated with the paper dust concentration in the developing container.

$$c = p[K \text{ sheets}]/t[\text{g}]$$

To be noted, the unit of the toner remaining amount t is not limited to g, and any arbitrary unit may be employed. Any index correlated with the toner remaining amount may be appropriately used. The same also applies to the passed-through sheet number p [K sheets]. The index may be, for example, the accumulated number of rotations of the developing roller 31, power supply time of the image forming apparatus, or the like, as long as the index is correlated with increase in the passed-through sheet number p.

In the case where the paper dust concentration C in the developing container 37 is higher than a certain value, occurrence of background fogging due to paper dust becomes prominent. Therefore, the upper limit value, that is, a threshold value, of the paper dust concentration index c corresponding to such a value of the paper dust concentration C will be referred to as cng. The upper limit value cng of the paper dust concentration index c is defined by the following formula (1) by using a passed-through sheet number png at the time when background fogging of an unacceptable level that is recognized as an image defect starts to occur in the case of actually performing image formation on the recording material by the image forming apparatus and a toner remaining amount tng of the same time.

$$cng = png/tng \quad (1)$$

A merit of using the paper dust concentration index c will be described. The passed-through sheet number png and the toner remaining amount tng at the occurrence of background fogging of an unacceptable level are affected by an image coverage (printing ratio, in other words) of an output image. The image coverage used herein is a ratio of the number of pixels where toner dots are plotted to the number of pixels constituting the region where an image can be formed. In addition, the amount of toner consumed for development changes by changing setting such as the value of the charging voltage or the developing voltage or the intensity of light radiated by the exposing unit, even in the case where the image coverage is the same. Therefore, the passed-through sheet number png of the case where background fogging of an unacceptable level has occurred in one condition may be greatly different from the passed-through sheet number png of the case where background fogging of an unacceptable level has occurred in another condition. Similarly, the toner remaining amount tng at the time of occurrence of background fogging of an unacceptable level may change greatly in accordance with, for example, the average value of image coverage of images that have been previously output.

In contrast, the value cng of the paper dust concentration index at which background fogging of an unacceptable level occurs is approximately constant regardless of conditions that affect the toner consumption speed with respect to the number of passed-through sheets, such as the image coverage and operation settings of the image forming operation. The conditions that affect the toner consumption speed will be hereinafter referred to as sheet passing conditions. For example, in the case where the image coverage is set to be higher, the amount of toner consumption per sheet is larger, and thus the toner remaining amount is reduced by a smaller number of passed-through sheets. That is, even in the case where the image coverage is set to be higher, since the passed-through sheet number png and the toner remaining amount tng at the time of occurrence of background fogging of an unacceptable level both become smaller, the value cng of the paper dust concentration index at which background fogging of an unacceptable level occurs is approximately the same as that of the case where the image coverage is lower.

To prevent background fogging derived from paper dust from occurring for a long period, toner replenishment notification may be performed such that the paper dust concentration index c does not exceed the upper limit value cng and the relationship of c<cng is maintained all the time.

In the present exemplary embodiment, the period in which the relationship of c<cng should be maintained is set to the value of passed-through sheet number p set as the lifetime of the image forming apparatus. This value will be hereinafter referred to as a lifetime sheet number plife. In other words, in the present exemplary embodiment, a state at a time point when the passed-through sheet number p has reached the lifetime sheet number plife is considered as a state in which the largest amount of paper dust is accumulated in the developing container. Further, the value of the paper dust concentration index c at a time when the passed-through sheet number p is the life time sheet number plife and the toner remaining amount in the developing container is approximately equal to the value tlow of toner remaining amount at which the toner replenishment notification is performed is set as clife. In this case, the following relationship may be satisfied for the value tlow of toner remaining amount at which the toner replenishment notification is performed, such that background fogging of an unacceptable level does not occur due to paper dust in the lifetime of the image forming apparatus.

$$clife = plife/tlow < cng \quad (2)$$

By rewriting the formula (2), tlow of the present exemplary embodiment is set to such a value as to satisfy the following inequality.

$$tlow > plife/cng \quad (3)$$

Procedure of Determining Threshold Value

A procedure of determining the value tlow of toner remaining amount at which toner replenishment notification is performed will be described below with reference to specific examples. It is assumed that the lifetime of the image forming apparatus is set to 30K sheets, that is, 30 thousand sheets, and the toner capacity of the developing container 37 is 143 g, which corresponds to the toner remaining amount of 100%. As the recording material, paper containing talc as filler was used. This paper will be hereinafter referred to as talc paper. In addition, the following experiment was performed in a high-temperature/high-humidity environment (32.5° C./80%) to test a condition prone to background fogging.

In addition, a procedure of obtaining the upper limit value cng of the paper dust concentration index c below which background fogging of an unacceptable level does not occur will be described. To obtain the upper limit value cng, the talc paper may be actually passed through the image forming apparatus, and the passed-through sheet number png and the toner remaining amount tng at a time point when background fogging of an unacceptable level has occurred may be used in the formula (1).

Here, the background fogging derived from accumulation of paper dust is, as described above, caused by decrease in the toner charge amount. As a result of an experiment that has been conducted in advance, it has been found that, in the configuration of the present exemplary embodiment, background fogging of an unacceptable level that is recognized as an image defect occurs in the case where the toner charge amount of the toner born on the developing roller 31 is equal to or smaller than −20 μC/g. In addition, it has been found that an image free from background fogging can be obtained in the case where the toner charge amount is equal to or larger than −25 μC/g. Therefore, in this experiment, talc paper was passed through the image forming apparatus, and whether or not background fogging occurred on the recording material was checked while measuring the toner charge amount each time the number of passed-through sheets increases by 1K sheets, from a time point when the number of passed-through sheets reached 4K sheets. "K sheets" of the number of passed-through sheets represents "thousand sheets". That is, 1K sheets represents 1000 sheets, and 4K sheets represents 4000 sheets. The same also applies to description below.

To be noted, as the talc paper, JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used. In addition, the toner charge amount is calculated as a value defined by the unit of C/g from a value obtained by sucking in the toner born on the developing roller 31 and measuring the weight and charge amount of the sampled toner by an electronic balance and a Faraday cage.

In addition, to confirm that the paper dust concentration index c is correlated with the paper dust concentration C in the developing container, particularly to confirm that the paper dust concentration index c is proportional to the paper dust concentration C in the developing container, the paper dust concentration C was measured more directly. Specifically, each time the number of passed-through sheets increased by 1K sheets after the number of passed-through sheets reached 4K sheets, part of toner in the developing container 37 was extracted and the talc concentration in the toner was quantified by using wavelength dispersive-type x-ray fluorescence analysis: XRF. As a method for quantification, samples of toner having different talc concentration in terms of weight percent concentration (wt %) were prepared, and a calibration curve was generated on the basis of X-ray intensity of a wavelength unique to magnesium element obtained from measurement results of the samples. Then, the calibration curve was applied to the X-ray intensity of the wavelength unique to magnesium element obtained for the toner extracted in the experiment, and thus the paper dust concentration C was obtained. To be noted, ZSX Primus IV manufactured by Rigaku Corporation was used as a wavelength dispersive-type X-ray fluorescence analyzer. The results are shown in Table 1.

TABLE 1

| Number of passed-through sheets | Toner charge amount [μC/g] | Paper dust (talc) concentration C [wt %] | Occurrence of background fogging Yes: Bad Slightly: Fair No: Good | Toner remaining amount [g] | Paper dust concentration index c |
|---|---|---|---|---|---|
| 0K sheets (initial state) | −40 | 0 | Good | 143 = tfull | 0 |
| 4K sheets | −28 | 0.5 | Good | 74.3 | 0.05 |
| 5K sheets | −23 | 0.8 | Fair | 55.4 | 0.09 |
| 6K sheets | −21 | 1.5 | Fair | 36.4 | 0.16 |
| 7K sheets = png | −20 | 3.8 = cng | Bad | 17 = tng | 0.41 = cng |

In the initial state in which paper dust was not mixed in the toner, the paper dust concentration C, that is, the talc concentration was 0 wt %. At this time, the toner charge amount was −40 μC/g, and background fogging did not occur. As the toner remaining amount was reduced by performing the sheet passing operation while appropriately adjusting the image coverage, it was confirmed that the paper dust concentration C in the developing container 37 increased and the toner charge amount decreased as the number of passed-through sheets of talc paper increased. The paper dust concentration C had increased to 0.8 wt % and the toner charge amount was smaller than −25 μC/g when 5K sheets was passed through. At this time, occurrence of slight background fogging on the recording material was recognized. When 7K sheets was passed through, the paper dust concentration C had increased to 3.8 wt %, and the toner charge amount was −20 μC/g. At this time, background fogging of an unacceptable level recognized as an image defect occurred on the recording material. The toner remaining amount at the time when the background fogging of an unacceptable level occurred was 17 g.

From the results described above, the upper limit value cng of the paper dust concentration c to prevent the background fogging of an unacceptable level from occurring in the image forming apparatus of the present exemplary embodiment is obtained as, by using cng=png/tng of the formula (1), cng=7 [K sheets]/17 [g]=0.41.

The value tlow of toner remaining amount at which toner replenishment notification is performed may be, according to the formula (3) and by using this value of cng, equal to or larger than plife/cng=30 [K sheets]/0.41 [K sheets/g] =73.1 g. In the present exemplary embodiment, tlow was set to 75 g, which was larger than the theoretical value described above, such that occurrence of background fogging can be more reliably suppressed even in a period close to the end of the lifetime of the image forming apparatus.

In the case where tlow is set in this manner, the value of the paper dust concentration index c is 30 [K sheets]/75 [g]=0.4 even when, for example, the toner remaining amount t at a time point when the number of passed-through sheets reaches 30K sheets is 75 g, which is equal to tlow. This value is smaller than the value of cng=0.41, which is a value of the paper dust concentration index at which background fogging of an unacceptable level occurs.

As shown in Table 1, it can be seen that the paper dust concentration index c and the actual paper dust concentration C measured by X-ray fluorescence analysis are approximately in a proportional relationship. Therefore, if the value of the paper dust concentration index c does not become larger than cng=0.41, the actual paper dust concentration C neither becomes larger than a value Cng=3.8 wt % at which background fogging of an unacceptable level occurs, and therefore occurrence of background fogging can be avoided. That is, in the case where the lifetime sheet number of the image forming apparatus of the present exemplary embodiment is set to 30K sheets, if the value tlow is set to 75 g, toner replenishment notification can be performed before background fogging of an unacceptable level occurs, at least until the number of passed-through sheets reaches the lifetime sheet number.

Control Method for Toner Replenishment Notification

Figure 6:
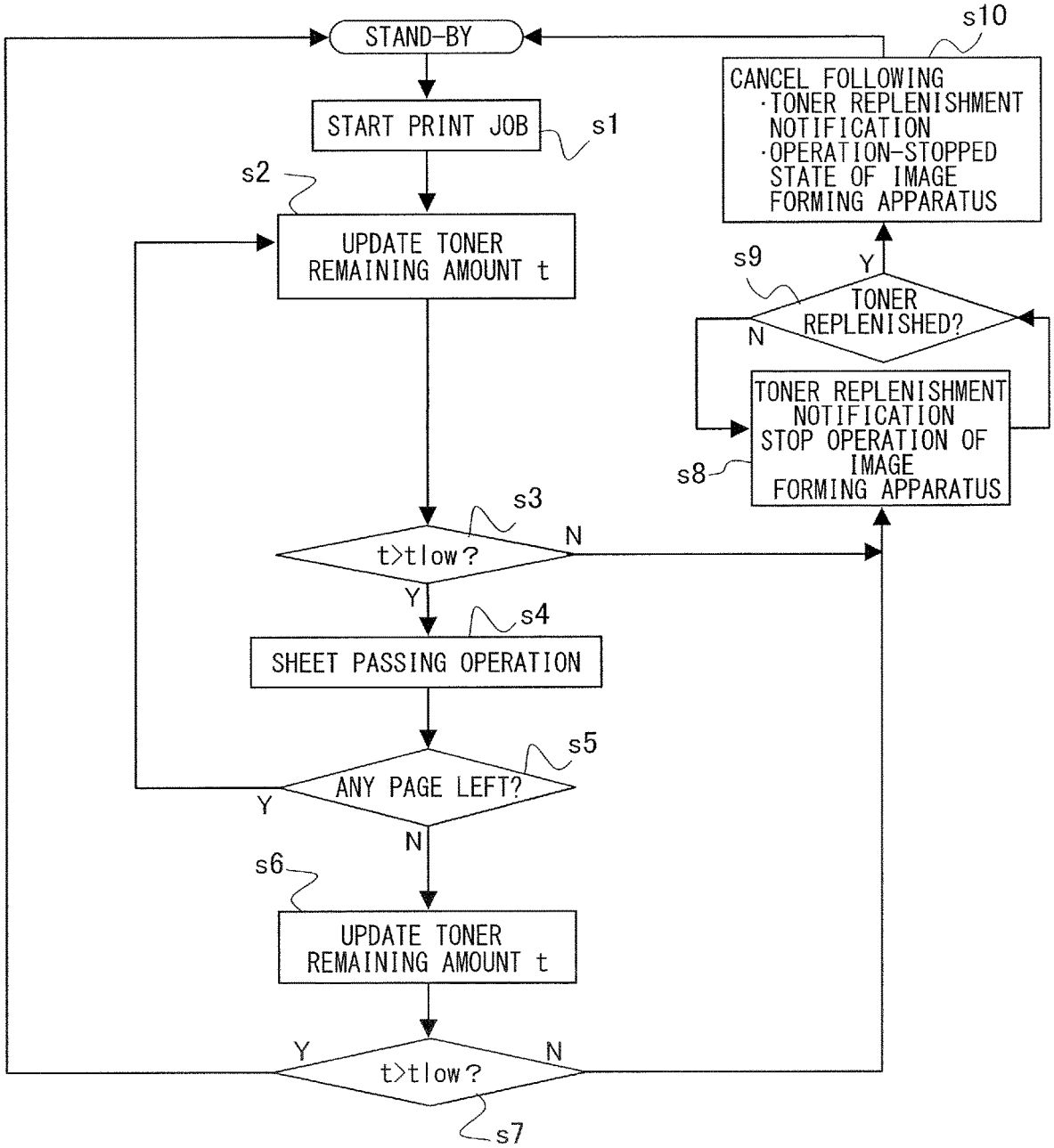
FIG. 6 is a flowchart illustrating a method of processing a print job according to the first exemplary embodiment.

FIG. 6 is a flowchart illustrating a control method for the image forming apparatus of the present exemplary embodiment. Each step of this process is executed by the CPU 51 of the controller 50 illustrated in FIG. 2 reading and executing a control program stored in the storage device 52. In addition, this process is continuously performed in a state in which the main power of the image forming apparatus is on. Processing of each step of the flowchart will be described below with reference to FIG. 2.

When the main power of the image forming apparatus is turned on, the image forming apparatus takes a stand-by state in which a print job can be accepted. A print job is a series of tasks for feeding a required number of sheets of recording material and forming images on the recording material, on the basis of image information and setting information such as the number of sheets of the recording material input from an external apparatus or the like.

Steps s1 to s3

When a print job is input to the image forming apparatus in the stand-by state, the CPU 51 starts executing the print job in step s1. At this time, driving of the driving motor 58 is started and the agitation blade 33 starts agitating the toner in the developing container 37, and therefore the toner remaining amount sensor 54 becomes capable of detecting the toner remaining amount. The CPU 51 updates the toner remaining amount t in the developing container by using the detection result of the toner remaining amount sensor 54 in step s2. The value of the toner remaining amount t is stored in a storage area prepared in the storage device 52.

Steps s4 and s5

To prevent background fogging from occurring until the number of sheets passed through in the image forming apparatus reaches the lifetime sheet number, a state in which the toner remaining amount t obtained in step s2 is always larger than the predetermined value tlow satisfying the relationship of the formula (3) described above may be maintained. In the present exemplary embodiment, in the case where the toner remaining amount t updated in step s2 is equal to or smaller than tlow=75 g, that is, in the case where the result of step s3 is N, it is determined that toner replenishment notification needs to be performed. To be noted, regarding the value tlow of toner remaining amount at which toner replenishment notification is performed, for example, a value obtained in advance by the experiment described with reference to Table 1 is stored in a nonvolatile storage area of the storage device 52 illustrated in FIG. 2 provided in the image forming apparatus.

In the case where the toner remaining amount t updated in step s2 is larger than tlow, that is, in the case where the result of step s3 is Y, it can be expected that background fogging of an unacceptable level does not occur, and therefore printing can be performed. In this case, the CPU 51 performs sheet passing operation of feeding the recording material and forming an image on the recording material in step s4. In the case where the print job requests image formation on a plurality of sheets of the recording material and there is a page yet to be subjected to image formation, that is, in the case where the result of step s5 is Y, the process returns to step s2 and the operation of steps s2 to s4 is repeated. In the case where there is no page yet to be subjected to image formation remaining, that is, in the case where the sheet passing operation has been performed on the last recording material in the job, in other words, in the case where the result of step s5 is N, the toner remaining amount t is updated in step s6, and it is determined in step s7 whether or not the toner remaining amount t has become equal to or smaller than tlow. In the case where the toner remaining amount t is larger than tlow, it is determined that there is no need to perform toner replenishment notification, the processing of the print job is finished, and the image forming apparatus returns to the stand-by state.

Steps s8 to s10

In the case where the toner remaining amount t is equal to or smaller than tlow, there is a possibility that background fogging of an unacceptable level occurs when the sheet passing operation is performed, depending on the degree of accumulation of paper dust. Therefore, in the present exemplary embodiment, in the case where the toner remaining amount t is equal to or smaller than tlow in step s3 or step s7, toner replenishment notification is issued to the user, and the operation of the image forming apparatus is stopped in step s8 to take a state in which the sheet passing operation is not performed.

Then, when it is detected that the user has performed toner replenishment operation, that is, in the case where the result of step s9 is Y, the toner replenishment notification and the state in which the operation of the image forming apparatus is stopped are cancelled in step s10, and the image forming apparatus returns to the stand-by state. In the present exemplary embodiment, in the case where the opening/closing detection sensor 53 has detected that opening/closing of the cover 38 has been performed, it is determined that the toner replenishment operation has been performed. To be noted, whether or not toner replenishment has been performed may be determined on the basis of a detection result of a sensor that detects attachment/detachment of the cap 35 illustrated in FIG. 5A to/from the opening portion 34 of the developing apparatus. In addition, for example, in the case where opening/closing of the cover 38 is detected by the opening/closing detection sensor 53, the toner remaining amount may be detected by temporarily driving the agitation blade 33, and in the case where increase in the toner remaining amount t is recognized, it may be determined that the toner replenishment notification has been performed.

Transition of Paper Dust Concentration Index and Toner Remaining Amount

Figure 7:
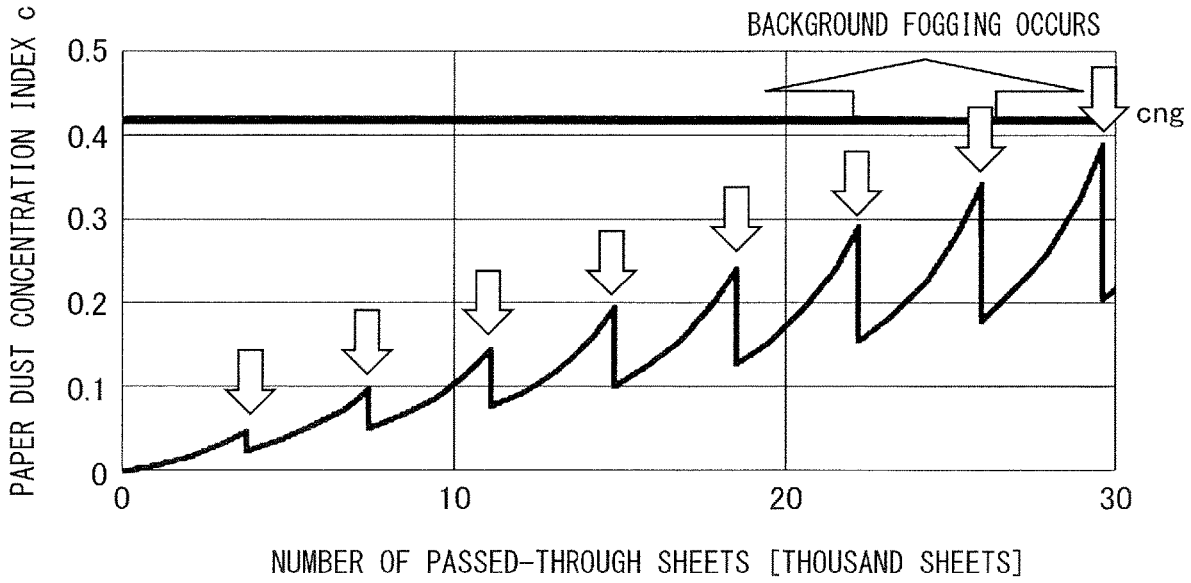
FIG. 7 is a graph showing an example of transition of a paper dust concentration index according to the first exemplary embodiment.
Figure 8:
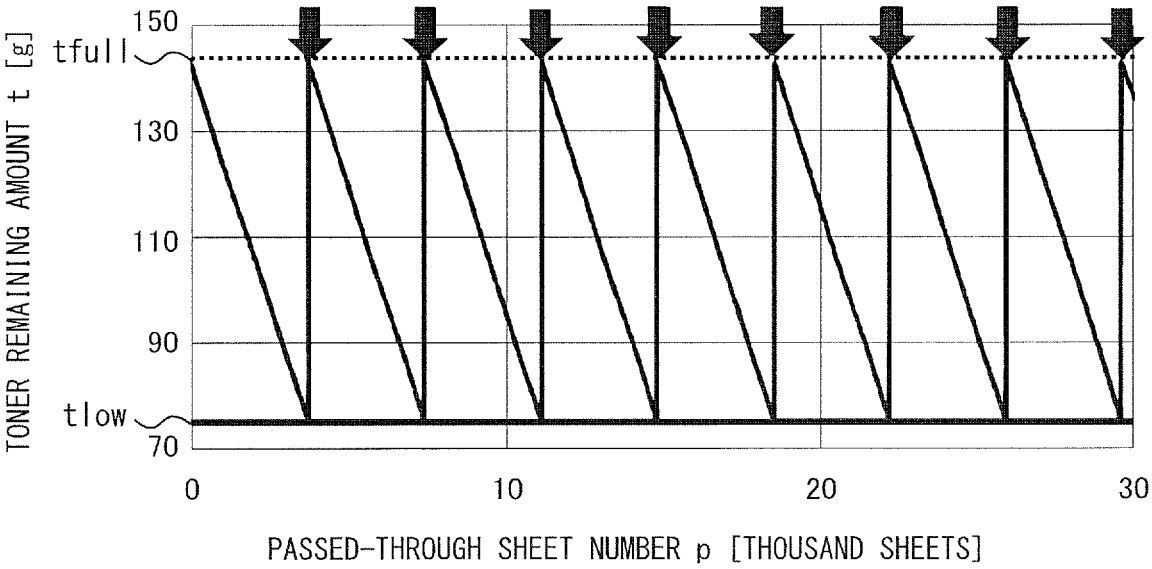
FIG. 8 is a graph showing an example of transition of toner remaining amount according to the first exemplary embodiment.

An example of transition of the paper dust concentration index c and the toner remaining amount t in the image forming apparatus that operates in accordance with the control method described above will be described with reference to FIGS. 7 and 8. The lifetime sheet number of the image forming apparatus in the example illustrated in FIGS. 7 and 8 is 30K sheets. The value tlow of toner remaining amount at which the toner replenishment notification is performed is set to 75 g, and toner is replenished to the maximum amount, that is, to tfull=143 g, each time toner replenishment is performed. In addition, a sheet passing operation of outputting images of an image coverage of 4% is repetitively performed until the number of passed-through sheets reaches the lifetime sheet number.

As illustrated in FIG. 7, the paper dust concentration index c increases quadratically in accordance with the increase in the passed-through sheet number p. This is because, as can be seen from the definition of the paper dust concentration index c, that is, c=p [K sheets]/t, the toner remaining amount t decreases as the toner is consumed in accordance with the increase in the passed-through sheet number p. The actual paper dust concentration C in the developing container 37 also increases in accordance with the paper dust concentration index c.

As illustrated in FIG. 8, when the toner remaining amount t decreases to tlow=75 g, the operation of the image forming apparatus is stopped, and toner replenishment notification is performed. Since results of experiment conducted in a condition in which the image coverage was constant at 4% is shown herein, each time the number of passed-through sheets increases by 3.7K sheets, the toner remaining amount t decreases from tfull=143 g to tlow=75 g and the toner replenishment notification is performed. When the user having received the toner replenishment notification replenishes toner, the toner remaining amount t increases to 143 g as indicated by black arrows in FIG. 8, and the paper dust concentration index c decreases in accordance with the increase in the toner remaining amount t as indicated by white arrows in FIG. 7. To be noted, when toner is replenished, the paper dust in the developing container is diluted by the replenishing toner in which no paper dust is mixed, and thus the actual paper dust concentration C also decreases.

In the example illustrated in FIGS. 7 and 8, although toner replenishment was performed 8 times before the passed-through sheet number p reached 30K sheets, which was the lifetime sheet number of the image forming apparatus, the paper dust concentration index c did not exceed the upper limit value cng=0.41 in this period as illustrated in FIG. 7. That is, before the actual paper dust concentration C reached the level in which background fogging of an unacceptable level would have occurred, the sheet passing operation was stopped, toner replenishment notification was performed, and toner was replenished. Therefore, the state in which background fogging of an unacceptable level did not occur was maintained for the whole lifetime of the image forming apparatus.

To be noted, the transition of the paper dust concentration C, the paper dust concentration index c, and the toner remaining amount t, the number of times of toner replenishment, and the number of passed-through sheets at which toner replenishment notification is performed illustrated in FIGS. 7 and 8 are mere examples. In actuality, these variants show transition different from the illustrated example, depending on factors such as the capacity of the developing container 37, the amount of toner actually replenished by the user, and change in the amount of toner consumption dependent on sheet passing conditions such as the image coverage and the operation settings of the image forming operation. However, regardless of such changes, occurrence of background fogging can be suppressed by obtaining in advance the upper limit value cng of the paper dust concentration index c below which background fogging of an unacceptable level does not occur and issuing toner replenishment notification to the user such that the paper dust concentration index c does not exceed the upper limit value cng.

As described above, in the present exemplary embodiment, toner replenishment notification is performed in the case where the toner remaining amount has become equal to or smaller than a certain threshold value tlow. This threshold value tlow is set such that the paper dust concentration index c correlated with the paper dust concentration in the developing container does not exceed the upper limit value cng for preventing occurrence of background fogging of an unacceptable level for the whole period of in which toner replenishment is performed a plurality of times, particularly for the lifetime of the image forming apparatus. In other words, replenishment information is notified to the user before an index correlated with the paper dust concentration in the developing container, which is the ratio of the amount of paper dust mixed in the developer in the developing container to the amount of the developer, exceeds a preset upper limit value. As a result of this, the possibility that the paper dust concentration in the developing container excessively increase and prominent background fogging occurs can be reduced, and an image forming apparatus capable of outputting high-quality image for a long period of time can be provided.

Modification Example

Although a case where talc paper is passed through as the recording material has been described in the first exemplary embodiment described above, a configuration in which a constant threshold value of toner remaining amount is used for the whole lifetime of the image forming apparatus may be applied to a case where a plurality of kinds of recording materials are passed through. For example, the threshold value tlow of toner remaining amount described in the first exemplary embodiment may be set as a threshold value tlow1 for talc paper, and a threshold value tlow2 of toner remaining amount is additionally set for calcium carbonate paper. For example, tlow2 is set to a value equal to A [g], which is the minimum amount of toner with which the developing roller 31 is covered by toner. This is because toner whose normal charging polarity is a negative polarity is used in the first exemplary embodiment and decrease in the toner charge amount is not likely to be caused by mixing calcium carbonate, which is likely to negatively charge another material, in the toner.

Further, for example, as an initial setting at the start of use of the image forming apparatus, the user is caused to select the material or brand of the recording material to be mainly used, and which of the threshold values tlow1 and tlow2 will be used is set on the basis of the result of the selection. Then, toner replenishment notification is performed when the toner remaining amount detected by the toner remaining amount sensor is equal to or smaller than the one of the threshold values tlow1 and tlow2 set in the initial setting. In this case, the number of passed-through sheets in a period from the initial state to the toner replenishment notification varies between the case where talc paper is passed through and the case where calcium carbonate paper is passed through. In other words, the number of passed-through sheets in the period from the initial state to the toner replenishment notification varies between the case where a first kind of recording material, which is talc paper in this case, is used and the case where a second kind of recording material, which is calcium carbonate paper in this case, is used. Therefore, the toner remaining amount at which background fogging of an unacceptable level does not occur can be more precisely judged in accordance with the kind of the recording material than in the first exemplary embodiment, and thus the user can be prompted to perform toner replenishment at a more appropriate timing.

Second Exemplary Embodiment

Next, an image forming apparatus according to a second exemplary embodiment will be described. The present exemplary embodiment is different from the first exemplary embodiment in that the value of the toner remaining amount at which toner replenishment notification is performed is changed. In the description below, elements having substantially the same configuration and effect as in the image forming apparatus of the first exemplary embodiment will be denoted by the same reference signs as in the first exemplary embodiment, and description thereof will be omitted.

Although the value tlow of toner remaining amount at which toner replenishment notification is performed is set to a constant value for the entire lifetime of the image forming apparatus in the first exemplary embodiment, in the present exemplary embodiment, the frequency of toner replenishment is reduced by configuring the value tlow to be appropriately changed.

As described in the first exemplary embodiment, background fogging of an unacceptable level is caused when the paper dust concentration C in the developing container is equal to or larger than a certain value Cng. Therefore, in the present exemplary embodiment, current paper dust concentration is evaluated by updating the paper dust concentration index c correlated with the paper dust concentration C, and the value tlow of toner remaining amount at which toner replenishment notification is performed is changed within such a range that the paper dust concentration index c does not exceed the upper limit value cng set in advance.

Control Method for Toner Replenishment Notification

Figure 9:
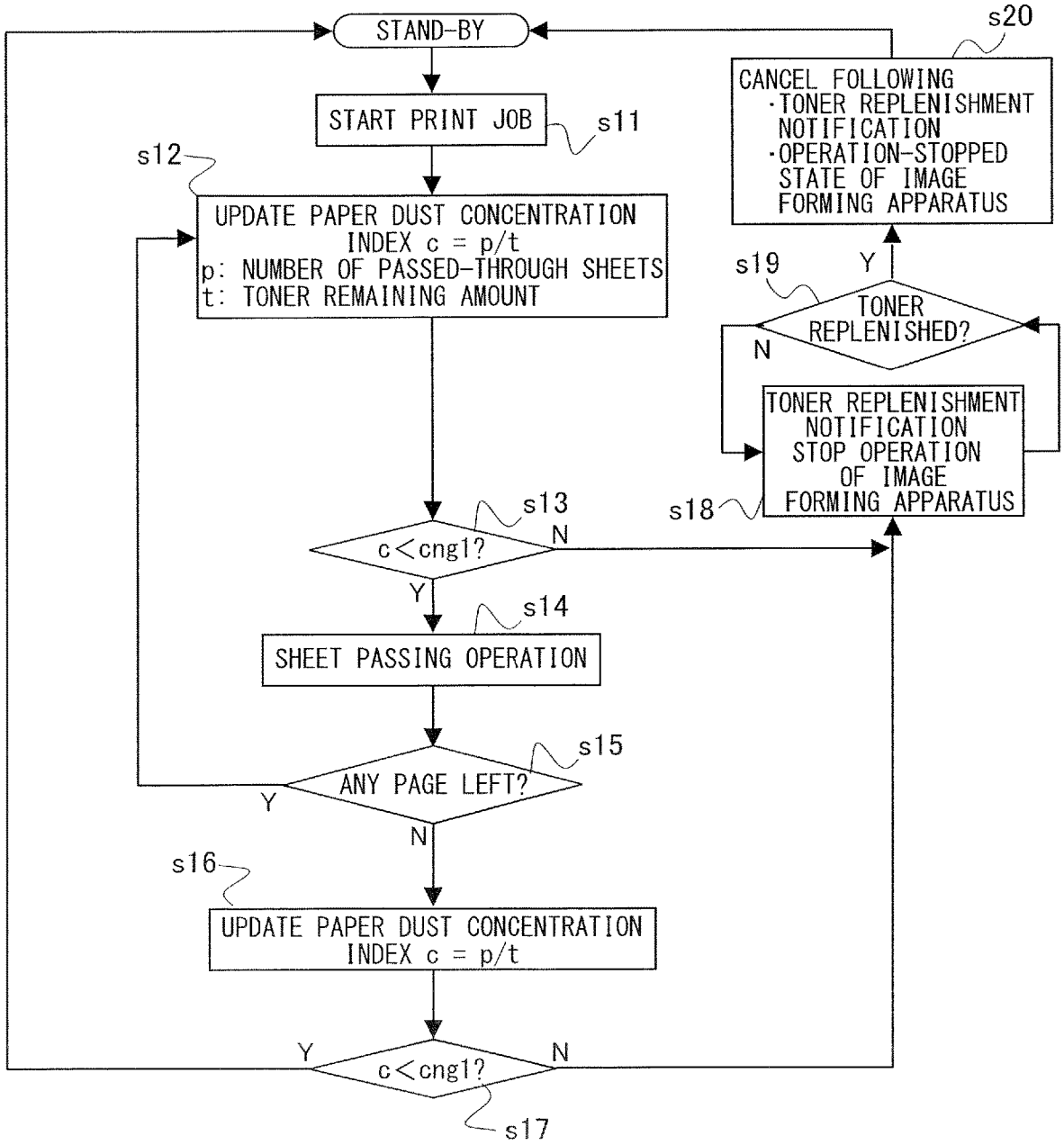
FIG. 9 is a flowchart illustrating a method of processing a print job according to a second exemplary embodiment.

FIG. 9 is a flowchart illustrating a control method for the image forming apparatus of the present exemplary embodiment. Each step of this process is executed by the CPU 51 of the controller 50 illustrated in FIG. 2 reading and executing a control program stored in the storage device 52. Processing of each step of the flowchart will be described below with reference to FIG. 2.

Steps s11 and s12

When a print job is input to the image forming apparatus in the stand-by state, the CPU 51 starts executing the print job in step s11. At this time, in step s12, the paper dust concentration index c=p [K sheets]/t is calculated again by using the toner remaining amount t in the developing container detected by using the toner remaining amount sensor 54 and the passed-through sheet number p of the image forming apparatus, and thus the value of the paper dust concentration index c is updated. The new value of the toner remaining amount t is stored in a storage area prepared in the storage device 52.

Steps s13 to s17

To prevent background fogging from occurring until the number of sheets passed through in the image forming apparatus reaches the lifetime sheet number, a state in which the paper dust concentration index c obtained in step s12 is always smaller than the upper limit value cng of the paper dust concentration index c set in advance may be maintained. The definition of the upper limit value cng of the paper dust concentration index is the same as in the first exemplary embodiment, which is the value of the paper dust concentration index c at which background fogging of an unacceptable level starts occurring. In the present exemplary embodiment, whether or not toner replenishment notification needs to be performed is determined by using a threshold value cng1 set to be smaller than the upper limit value cng, that is, cng1<cng holds. That is, in the case where the paper dust concentration index c updated in step s12 is not smaller than the threshold value cng1, which corresponds to a case where the result of step s13 is N, it is determined that toner replenishment notification needs to be performed. To be noted, regarding the threshold value cng1, for example, a value set on the basis of a value of cng empirically obtained in advance is stored in a nonvolatile storage area of the storage device 52 illustrated in FIG. 2 provided in the image forming apparatus.

The possibility of occurrence of background fogging of an unacceptable level can be more reliably reduced in the case where the threshold value cng1 is set to a smaller value to secure a larger difference cng−cng1 between the threshold value cng1 and the upper limit value cng. However, if the threshold value cng1 is too small, the number of times toner replenishment notification is issued to the user becomes large, which can lead to degradation of the usability. In the present exemplary embodiment, the threshold value cng1 is set to "0.4", which is smaller than the upper limit value cng=0.41 of the paper dust concentration index.

To be noted, the value tlow of toner remaining amount at which toner replenishment notification is performed in the present exemplary embodiment is a value of the toner remaining amount t at the time when the paper dust concentration index c is equal to the threshold value cng1. This value tlow and the threshold value cng1 of the paper dust concentration index have the following relationship.

$$cng1=p/tlow \quad (4)$$

Therefore, the value tlow of toner remaining amount at which toner replenishment notification is performed in the present exemplary embodiment can be expressed by the following formula.

$$tlow=p/cng1 \quad (5)$$

That is, the value tlow of toner remaining amount at which toner replenishment notification is performed in the present exemplary embodiment increases as the passed-through sheet number p increases. This is because, as the passed-through sheet number p increases, the amount of paper dust having entered the developing container increases, and therefore the toner remaining amount t required for maintaining the paper dust concentration C in the developing container equal to or smaller than a certain value becomes larger. Conversely, in a state in which the passed-through sheet number p is still small, the amount of paper dust having entered the developing container is still small, and therefore background fogging of an unacceptable level does not occur until the toner remaining amount t in the developing container becomes smaller.

As described above, in the case where the paper dust concentration index c updated in step s12 is smaller than the threshold value cng1, that is, in the case where the result of step s13 is Y, it can be expected that background fogging of an unacceptable level does not occur, and therefore it is determined that printing can be performed. In this case, the CPU 51 performs the sheet passing operation of feeding the recording material and forming an image on the recording material in step s14. In the case where the print job requests image formation on a plurality of sheets of the recording material and there is a page yet to be subjected to image formation, that is, in the case where the result of step s15 is Y, the process returns to step s12 and the operation of steps s12 to s14 is repeated. In the case where there is no page yet to be subjected to image formation remaining, that is, in the case where the sheet passing operation has been performed on the last recording material in the job, in other words, in the case where the result of step s15 is N, the paper dust concentration index c is updated in step s16, and it is determined in step s17 whether or not the paper dust concentration index c has become equal to or smaller than the threshold value cng1. In the case where the paper dust concentration index c is smaller than the threshold value cng1, it is determined that there is no need to perform toner replenishment notification, the processing of the print job is finished, and the image forming apparatus returns to the stand-by state.

Steps s18 to s20

In the case where the paper dust concentration index c is not smaller than the threshold value cng1, there is a possibility that background fogging of an unacceptable level occurs when the sheet passing operation is performed. Therefore, in the present exemplary embodiment, in the case where the paper dust concentration index c is equal to or larger than the threshold value cng1 in step s13 or step s17, toner replenishment notification is issued to the user, and the operation of the image forming apparatus is stopped in step s18 to take a state in which the sheet passing operation is not performed.

Then, when it is detected that the user has performed toner replenishment operation, that is, in the case where the result of step s19 is Y, the toner replenishment notification and the state in which the operation of the image forming apparatus is stopped are cancelled in step s20, and the image forming apparatus returns to the stand-by state. To be noted, whether or not toner replenishment has been performed is determined by, for example, detecting the opening/closing of the cover 38 by the opening/closing detection sensor 53 similarly to the first exemplary embodiment.

As described above, in the present exemplary embodiment, toner replenishment notification is issued to the user such that the paper dust concentration index c is always smaller than the upper limit value cng set in advance for preventing occurrence of background fogging of an unacceptable level. As can be seen from the formula (5), the value tlow of toner remaining amount at which toner replenishment notification is performed is changed in accordance with the passed-through sheet number p, and the value tlow is smaller in the case where the passed-through sheet number p is smaller. That is, the toner remaining amount at which the next toner replenishment notification is performed is larger than the toner remaining amount at which the previous toner replenishment notification has been performed. As compared with the first exemplary embodiment, the timing at which toner replenishment notification is performed can be delayed, that is, the frequency of notification can be reduced in a state in which the passed-through sheet number p is small, and thus the number of times toner replenishment by the user is requested can be reduced as much as possible.

Reduction of Number of Times of Toner Replenishment

The number of times of toner replenishment in each exemplary embodiment will be described with reference to specific examples. In the following experiment, the sheet passing operation was performed in the same sheet passing condition as in the example described in the first exemplary embodiment, whereas the value tlow of toner remaining amount at which toner replenishment notification was performed was changed. That is, a sheet passing operation of outputting images of an image coverage of 4% on talc paper was repetitively performed until the number of passed-through sheets reached the lifetime sheet number. The lifetime sheet number of the image forming apparatus was 30K sheets. In each toner replenishment, toner was replenished to the maximum amount tfull=143 g. In addition, the experiment was conducted in a high-temperature high-humidity environment (32.5° C./80%). As the talc paper, JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used.

Figure 10:
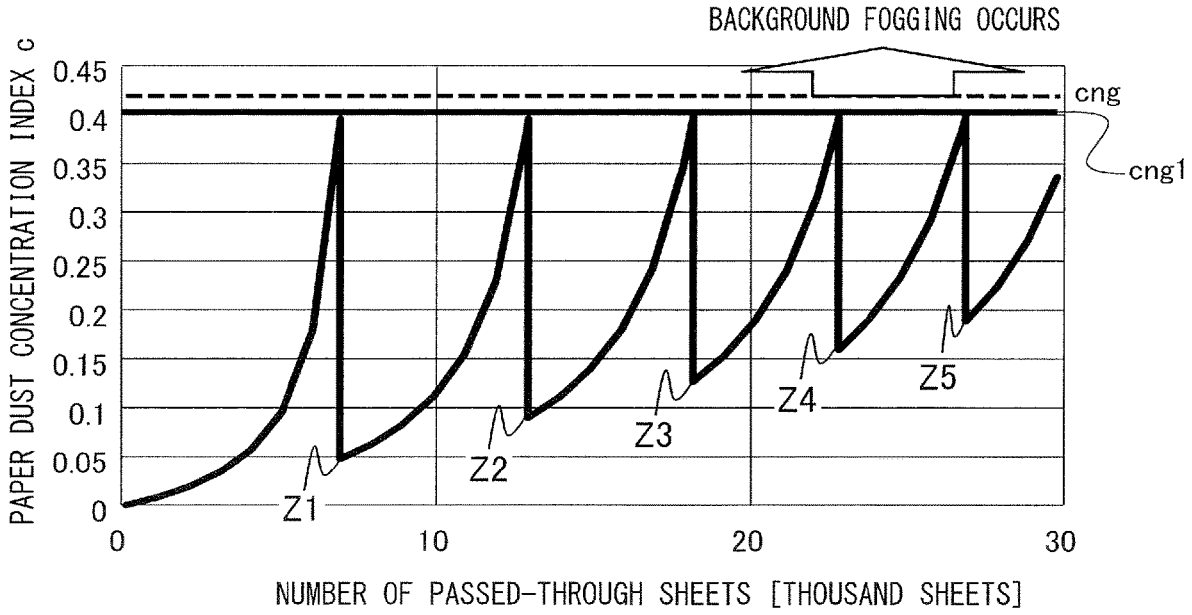
FIG. 10 is a graph showing an example of transition of a paper dust concentration index according to the second exemplary embodiment.

An example of transition of the paper dust concentration index c and the toner remaining amount t in the experiment of this time will be described with reference to FIGS. 10 and 11. As illustrated in FIG. 10, the paper dust concentration index c increases quadratically in accordance with the increase in the passed-through sheet number p for the same reason as in the first exemplary embodiment. The actual paper dust concentration C in the developing container, that is, the talc concentration also increases similarly to the paper dust concentration index c. Then, when the paper dust concentration index c increases to the predetermined threshold value cng1, toner replenishment notification is performed. The user having received the toner replenishment notification replenishes toner, thus the toner remaining amount recovers to tfull=143 g, and the paper dust concentration index c decreases as indicated by Z1 to Z5 in FIGS. 10 and 11.

Here, in the first exemplary embodiment, toner replenishment notification is performed when the toner remaining amount becomes equal to or smaller than a certain threshold value, which is 75 g in this case. However, in a state in which the passed-through sheet number p is small, toner replenishment notification is performed in a state in which the actual paper dust concentration C is sufficiently small with respect to the paper dust concentration Cng at which background fogging of an unacceptable level occurs, that is, in a state in which the difference between C and Cng is large, as illustrated in FIG. 7.

In contrast, in the present exemplary embodiment, whether or not to perform toner replenishment notification is determined by comparing the paper dust concentration index c with the threshold value cng1. It is known that, in the configuration of the present exemplary embodiment, background fogging of an unacceptable level does not occur in the case where the paper dust concentration C, that is, the talc concentration is smaller than 3.8 wt %, and the upper limit value cng of the paper dust concentration index c corresponding to this paper dust concentration is 0.4. Therefore, toner replenishment notification may be performed when the paper dust concentration index c has increased to the threshold value cng1 smaller than the upper limit value cng, regardless of whether or not the toner remaining amount is smaller than the threshold value of the first exemplary embodiment, which is 75 g.

Figure 11:
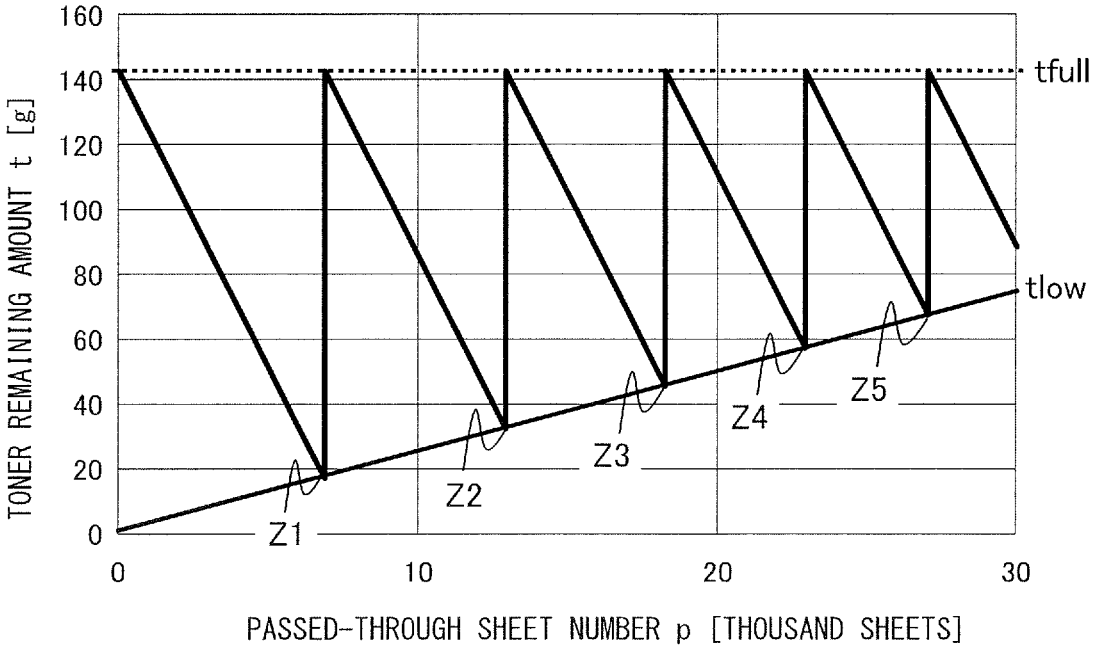
FIG. 11 is a graph showing an example of transition of toner remaining amount according to the second exemplary embodiment.

In this experiment, the first toner replenishment notification is performed when the passed-through sheet number p is 6.87K sheets, that is, 6870 sheets, as indicated by Z1 in FIGS. 10 and 11. The value of the toner remaining amount t at this time, that is, the value tlow is 17.2 g, and the paper dust concentration index c is p/t=6.87 [K sheets]/17.2 [g]≈0.4=cng1. Then, when the user performs toner notification and inputs the next print job, since the toner remaining amount t in the developing container has increased from tlow=17.2 g to tfull=143 g, the paper dust concentration index c drops steeply as illustrated in FIG. 10.

Then, the second toner replenishment notification is performed when the passed-through sheet number p is 12.91K sheets, that is, 12910 sheets, as indicated by Z2 in FIGS. 10 and 11. The value of the toner remaining amount t at this time, that is, the value tlow is 32.4 g, and the paper dust concentration index c is p/t=12.91 [K sheets]/32.4 [g]≈0.4=cng1. That is, the value tlow of toner remaining amount at which the second toner replenishment notification is performed, which exemplifies a second amount, is larger than the value of toner remaining amount at which the first toner replenishment notification has been performed, which exemplifies a first amount.

In the present exemplary embodiment, the value tlow of toner remaining amount at which toner replenishment notification should be performed is expressed as a straight line illustrated in FIG. 10, with respect to the passed-through sheet number p. As expressed in the formula (5), tlow increases proportionally to the increase in the passed-through sheet number p. This is because the amount of paper dust in the developing container increases as the passed-through sheet number p increases, and therefore the toner remaining amount required for keeping the paper dust concentration in the developing container equal to or smaller than a certain value increases as the passed-through sheet number p increases.

As a result of continuing the sheet passing operation while repetitively performing toner replenishment after performing the second toner replenishment until reaching 30K sheets, which is the lifetime sheet number, the toner replenishment needed to be performed five times before the number of passed-through sheets reached 30K sheets, as illustrated in FIGS. 10 and 11. Therefore, since the toner replenishment needed to be performed eight times in the first exemplary embodiment in which the sheet passing operation was performed in such a sheet passing condition that the amount of toner consumption per passed-through sheet was approximately constant as illustrated in FIGS. 7 and 8, it has been confirmed that the number of times and frequency by which the user is requested for toner replenishment can be reduced. To be noted, in an actual use condition of the image forming apparatus, the number of times of toner replenishment is performed before the number of passed-through sheets reaches the lifetime sheet number changes in accordance with factors such as the image coverage, the amount of toner replenished in toner replenishment, and the setting of the threshold value cng1. However, if at least certain conditions such as the amount of toner consumption per passed-through sheet being approximately constant and toner being replenished to approximately the maximum amount tfull at the time of toner replenishment are satisfied, the number of times of toner replenishment can be reduced as compared with the first exemplary embodiment.

To be noted, in the present exemplary embodiment, as described for step s14 of FIG. 9, the paper dust concentration index c is calculated before starting each sheet passing operation, and toner replenishment notification is performed on the basis of the result of comparison between the paper dust concentration index c and the threshold value cng1. However, the paper dust concentration index c does not necessarily have to be performed before performing each sheet passing operation, and an effect similar to that of the present exemplary embodiment can be also obtained in the case where toner replenishment notification is performed when the toner remaining amount t has decreased to the predetermined threshold value tlow. In this case, the value tlow serving as a threshold value may be obtained from the relationship of the formula (5) on the basis of, for example, the threshold value cng1 of the paper dust concentration index empirically obtained in advance and the passed-through sheet number p. According to this method, whether or not to perform toner replenishment notification can be determined on the basis of only information about the threshold value cng1, which is a constant, the current passed-through sheet number p, and the current toner remaining amount t detected by the toner remaining amount sensor 54, without preparing a storage area for storing the current paper dust concentration index c.

Third Exemplary Embodiment

Although a configuration example in which a case where paper including talc as filler, that is, talc paper is passed through has been described in the first and second exemplary embodiments, various kinds of paper dust different from talc are also generated from a sheet material used as the recording material. Therefore, in the present exemplary embodiment, a configuration example in which a case where talc paper and paper containing calcium carbonate as filler serving as an example of a recording material that is a different material from talc paper are passed through will be described. The paper containing calcium carbonate will be hereinafter referred to as calcium carbonate paper. In the description below, elements having substantially the same configuration and effect as in the image forming apparatus of the first and second exemplary embodiments will be denoted by the same reference signs as in the first and second exemplary embodiments, and description thereof will be omitted.

Since the normal charging polarity of the toner used in the present exemplary embodiment is a negative polarity, decrease in the toner charge amount is not likely to occur even if calcium carbonate, which has a characteristic of being likely to be positively charged and negatively charge another material, enters the developing container. Therefore, as long as only the calcium carbonate paper is passed through, the likelihood of occurrence of background fogging derived from paper dust does not change much even if the number of passed-through sheet increases. Therefore, in the present exemplary embodiment, whether or not to perform toner replenishment notification is determined assuming that the concentration of paper dust that causes decrease in the toner charge amount in the developing container, for example, talc, does not increase while calcium carbonate paper is passed through. This enables more precisely judging the level of toner remaining amount below which background fogging does not occur, and enables reducing the number of times of toner replenishment more than in the second exemplary embodiment.

In the present exemplary embodiment, the value tlow of toner remaining amount at which toner replenishment notification is performed is changeable similarly to the second exemplary embodiment, and tlow is appropriately changed in accordance with the material of the recording material that is passed through. Specifically, as two paper dust concentration indices, a paper dust concentration index c1 correlated with paper dust concentration derived from talc paper, which is likely to cause decrease in the toner charge amount, and a paper dust concentration index c2 correlated with paper dust concentration derived from calcium carbonate paper, which is not likely to cause decrease in the toner charge amount, are defined. In the following formulae (6) and (7), p1 represents the number of passed-through sheets of talc paper, and p2 represents the number of passed-through sheets of calcium carbonate paper.

$$c1=p1/t \quad (6)$$

$$c2=p2/t \quad (7)$$

To be noted, the relationship between the total passed-through sheet number p of the image forming apparatus and the lifetime sheet number plife of the image forming apparatus is expressed by the following formula (8).

$$p=p1+p2<p\mathrm{life} \quad (8)$$

In addition, the threshold value cng1 and the value tlow of toner remaining amount at which toner replenishment notification is performed are defined by the following formulae corresponding to the formulae (4) and (5) described in the second exemplary embodiment.

$$cng1=p1/t\mathrm{low} \quad (4')$$

$$tlow=p1/cng1 \quad (5')$$

The recording material S passed through the image forming apparatus is identified by, for example, analyzing, by the CPU 51 of the image forming apparatus having received the print job, the received data in the case where the user has selected the brand or kind of the recording material S on a screen of a personal computer: PC that has transmitted the print job. In addition, a configuration in which the kind of the recording material S can be registered through the operation portion 55 of the image forming apparatus may be employed, and the recording material S may be identified on the basis of the registered information. In addition, in the case where a detection portion such as a sensor that automatically detects filler and additives contained in the recording material S is provided, the identification may be performed by the detection portion.

As expressed by the formulae (8) and (5'), in the present exemplary embodiment, the total passed-through sheet number p of the image forming apparatus is not equal to the passed-through sheet number p1 of talc paper used for determining whether or not to perform toner replenishment notification. Further, in a period in which calcium carbonate paper is passed through, whereas the total passed-through sheet number p increases, the passed-through sheet number p1 of talc paper does not increase. Therefore, the value tlow of toner remaining amount at which toner replenishment notification is performed does not change in this period. As will be described later with reference to specific examples, according to such settings, the value tlow of toner remaining amount at which toner replenishment notification is performed can be reduced further as compared with the second exemplary embodiment while maintaining a state in which background fogging of an unacceptable level does not occur.

The control method for the image forming apparatus of the present exemplary embodiment is basically the same as in the control method of the second exemplary embodiment described with reference to FIG. 9, and therefore the description thereof will be omitted. However, in the present exemplary embodiment, "paper dust concentration index c" in steps s12, s13, s16, and s17 in FIG. 9 are replaced by "paper dust concentration index c1 of talc paper" defined by the formula (6).

The number of times of toner replenishment in the present exemplary embodiment will be described with reference to specific examples. The threshold value cng1 of the paper dust concentration index c1 at which toner replenishment notification is performed in the present exemplary embodiment is set to 0.40 similarly to the second exemplary embodiment. That is, the value tlow of toner remaining amount at which toner replenishment notification is performed is expressed as follows by using the formula (5') in the present exemplary embodiment.

$$tlow=p1/0.40$$

As can be seen from the formula described above, tlow changes in accordance with the passed-through sheet number p1 of talc paper similarly to the second exemplary embodiment.

In the experiment described below, the same sheet passing conditions as in the second exemplary embodiment were used except that both of talc paper and calcium carbonate paper were passed through. That is, the sheet passing operation of outputting an image of an image coverage of 4% on talc paper or calcium carbonate paper was repetitively performed until the number of passed-through sheets reached the lifetime sheet number. The lifetime sheet number of the image forming apparatus was 30K sheets. In each toner replenishment, toner was replenished to the maximum amount tfull=143 g. In addition, the experiment was conducted in a high-temperature high-humidity environment (32.5° C./80%). As the talc paper, JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used. As the calcium carbonate paper, Vitality Multipurpose Printer Paper manufactured by Xerox (size: Letter, grammage: 75 g/m$^2$) left in the high-temperature high-humidity environment (32.5° C./80%) serving as the experimental environment for 2 days was used.

Figure 12:
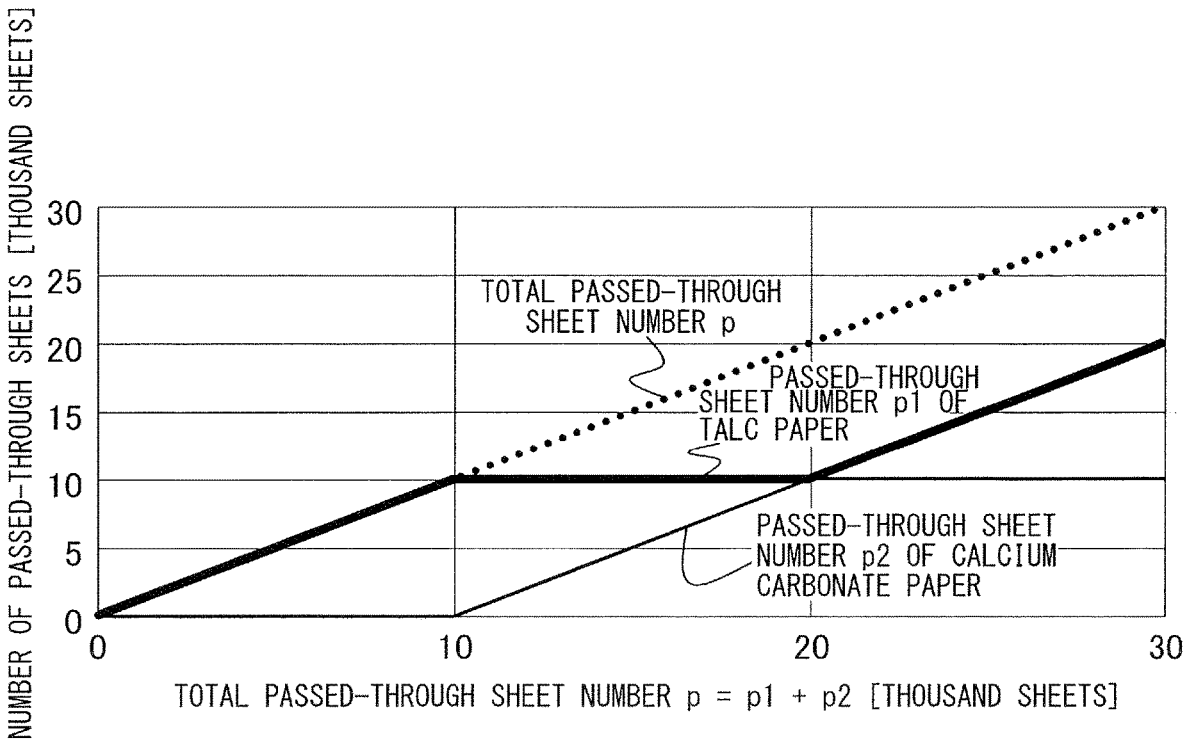
FIG. 12 is a graph showing an example of transition of a number of passed-through sheets of each kind of recording material according to a third exemplary embodiment.

FIG. 12 illustrates a sheet passing schedule of talc paper and calcium carbonate paper in the present experiment. In the present experiment, 10K sheets of talc paper were passed through from the initial state, then 10K sheets of calcium carbonate paper were passed through, and finally 10K sheets of talc paper were passed through. Therefore, in the section from 10K sheets to 20K sheets in terms of the total passed-through sheet number p, the passed-through sheet number p1 of talc paper that causes paper dust leading to decrease in the toner charge amount is constant.

Figure 13:
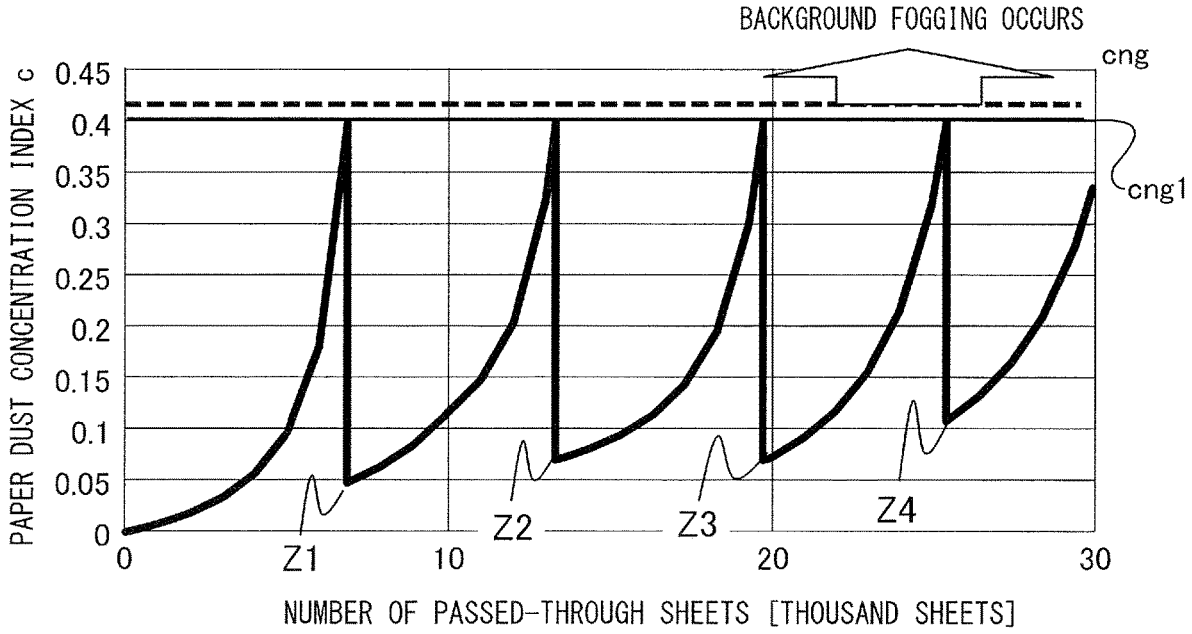
FIG. 13 is a graph showing an example of transition of a paper dust concentration index according to the third exemplary embodiment.

An example of transition of the paper dust concentration index c and the toner remaining amount t in the present experiment will be described with reference to FIGS. 13 and 14. As illustrated in FIG. 13, in the period in which talc paper is passed through, the paper dust concentration index c quadratically increases in accordance with the increase in the passed-through sheet number p for the same reason as in the first exemplary embodiment. Meanwhile, when calcium carbonate paper starts being passed through, the speed of increase in the paper dust concentration index c1 becomes slow as compared with the speed of increase in the paper dust concentration index c in the second exemplary embodiment. This is because in the section from 10K sheets to 20K sheets in which calcium carbonate paper is passed through, the passed-through sheet number p1 of talc paper is constant and the paper dust concentration index c1 increases mainly due to decrease in the toner remaining amount t. Similarly to the transition of the paper dust concentration index c1, the speed of increase in the actual talc concentration also becomes slow in the section from 10K sheets to 20K sheets in which calcium carbonate paper is passed through, because new talc does not enter the developing container.

As described above, also in the present exemplary embodiment, the paper dust concentration index c1 is in a proportional relationship with the concentration of talc that causes decrease in the toner charge amount in an actual developing container similarly to the cases described in the first exemplary embodiment and the second exemplary embodiment. Therefore, toner replenishment notification is performed when the paper dust concentration index c1 reaches the threshold value cng1=0.4 smaller than the upper limit value cng=0.41 as indicated by Z1 to Z4 of FIGS. 13 and 14 such that the value of the paper dust concentration index c1 does not exceed the upper limit value cng below which background fogging of an unacceptable level does not occur. The user having received the toner replenishment notification replenishes toner, thus the toner remaining amount recovers to tfull=143 g, and the paper dust concentration index c1 decreases. As a result of this, the actual talc concentration neither exceeds the concentration Cng=3.8 wt % at which background fogging of an unacceptable level occurs, and thus the possibility of occurrence of background fogging of an unacceptable level is reduced.

Figure 14:
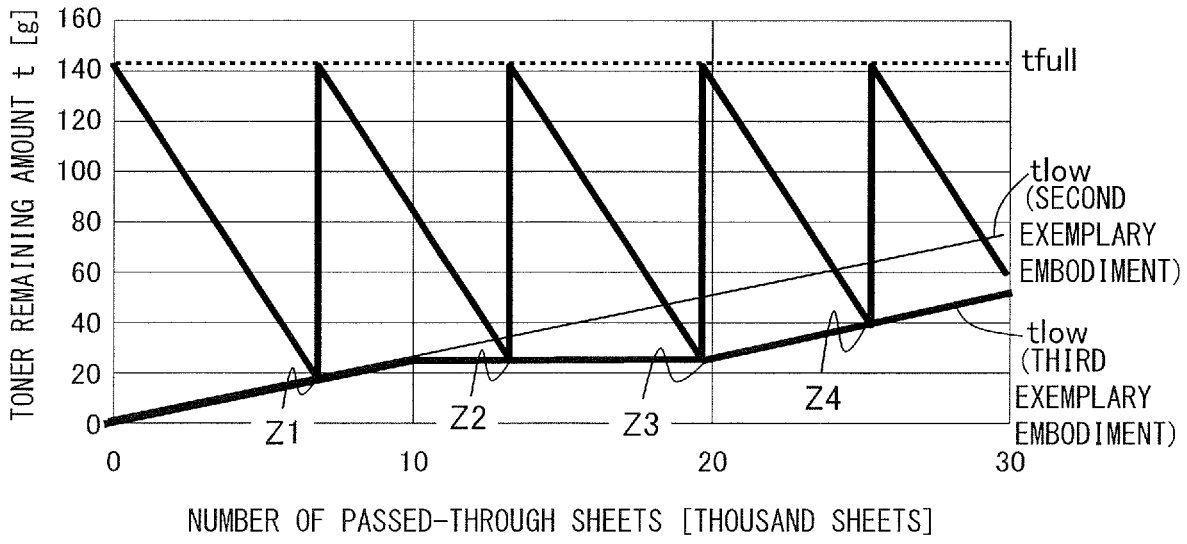
FIG. 14 is a graph showing an example of transition of toner remaining amount according to the third exemplary embodiment.

In the present exemplary embodiment, the value tlow of toner remaining amount at which toner replenishment notification is performed is expressed as a solid line illustrated in FIG. 14, with respect to the passed-through sheet number p. As expressed in the formula (5'), tlow increases proportionally to the increase in the passed-through sheet number p1 of talc paper. This is because the amount of talc in the developing container increases as the passed-through sheet number p1 of talc paper increases, and therefore the toner remaining amount required for keeping the talc concentration in the developing container equal to or lower than a level below which background fogging of an unacceptable level does not occur increases as the passed-through sheet number p1 increases.

In the present experiment, similarly to the experiment described in the second exemplary embodiment, the first toner replenishment notification was performed when the passed-through sheet number p1 of talc paper was 6.87K sheets as indicated by Z1 in FIGS. 13 and 14. The toner remaining amount t at this time was 17.2 g, and the paper dust concentration index c1 of talc paper was c1=p1/t=6.87 [K sheets]/17.2 [g]≈0.4=cng1.

After that, the passed-through sheet number p1 of talc paper was constant at 10K sheets in the section from 10K sheets to 20K sheets in terms of the total passed-through sheet number p because calcium carbonate paper that is not likely to cause decrease in the toner charge amount was passed through in this section. Therefore, the value tlow of toner remaining amount at which toner replenishment notification was performed in the section described above was constant at tlow=10 [K sheets]/0.40 [K sheets/g]=25 [g] according to the formula (5') as illustrated in FIG. 14.

The second toner replenishment notification indicated by Z2 in FIGS. 13 and 14 was performed on the basis of the toner remaining amount t having decreased to tlow=25 g when the total passed-through sheet number p was 13.31K sheets. The third toner replenishment notification indicated by Z3 in FIGS. 13 and 14 was similarly performed on the basis of the toner remaining amount t having decreased to tlow=25 g when the total passed-through sheet number p was 19.75K sheets.

Then, when the total passed-through sheet number p exceeded 20K sheets, talc paper that causes decrease in the toner charge amount started being passed through again, and therefore the passed-through sheet number p1 of talc paper started increasing from 10K sheets. Therefore, in this section, tlow also increased proportionally to the passed-through sheet number p1 of talc paper in accordance with increase in the total passed-through sheet number p.

The fourth toner replenishment notification indicated by Z4 of FIGS. 13 and 14 was performed when the total passed-through sheet number p was 25.45K sheets, that is, when the passed-through sheet number p1 of talc paper was 15.45K sheets. The toner remaining amount t at this time was 38.6 g, and the paper dust concentration index c1 of talc paper was c1=p1/t=15.45 [K sheets]/38.6 [g]≈0.4=cng1. Then, the total passed-through sheet number p reached 30K sheets, which was the lifetime sheet number, before the fifth toner replenishment notification was performed.

As described above, in the present experiment, the number of times of toner replenishment notification performed before the total passed-through sheet number p reached 30K sheets, which was the lifetime sheet number, was four, which was further smaller than five of the experimental result of the second exemplary embodiment. Therefore, it has been confirmed that, by taking the material of the recording material into consideration, the level of toner remaining amount below which background fogging of an unacceptable level does not occur can be judged more precisely, and the number of times and frequency by which the user is requested for toner replenishment can be reduced.

To be noted, in the present exemplary embodiment, talc paper and calcium carbonate paper were respectively described as examples of a recording material that is likely to cause decrease in the toner charge amount and a recording material that is not likely to cause decrease in the toner charge amount. Generally, the value tlow of toner remaining amount at which toner replenishment notification should be performed can be obtained as follows in an image forming apparatus in which a plurality of kinds of recording materials can be passed through.

Modification Example 1

For example, a case where four kinds of paper including paper A1, paper A2, paper B, and paper C are passed through is assumed. The paper dust concentration indices of respective papers will be referred to as c(a1), c(a2), c(b), and c(c). Upper limit values cng(a1), cng(a2), cng(b), and cng(c) below which background fogging of an unacceptable level do not occur are obtained in advance for respective papers by the method described in the first exemplary embodiment. In addition, threshold values cng1(a1), cng1(a2), cng1(b), and cng1(c) of paper dust concentration indices used for determining whether or not to perform toner replenishment notification are respectively set to be smaller than cng(a1), cng(a2), cng(b), and cng(c).

In the case where the numbers of passed-through sheets of the papers A1 to C are respectively represented by p(a1), p(a2), p(b), and p(c), the value of toner remaining amount at which toner replenishment notification is performed in the case where only one kind of paper is passed through is expressed as follows similarly to the formula (5).

$$tlow(a1)=p(a1)/cng1(a1)$$

$$tlow(a2)=p(a2)/cng1(a2)$$

$$tlow(b)=p(b)/cng1(b)$$

$$tlow(c)=p(c)/cng1(c)$$

In the case where a plurality of kinds of paper are passed through, toner replenishment notification may be performed when the current toner remaining amount becomes equal to or smaller than the largest value among tlow(a1) to tlow(c). As a result of this, toner replenishment notification is performed before the concentration of paper dust derived from respective papers reaches a level at which background fogging occurs, and therefore occurrence of background fogging can be suppressed.

Modification Example 2

In addition, there is a case where the same filler is contained in a plurality of kinds of recording material. For example, it is assumed that, in an image forming apparatus in which the paper A1 and the paper A2 can be passed through, the paper A1 and the paper A2 are both talc paper containing talc as filler. In addition, it is assumed that the talc content is different between the paper A1 and the paper A2, and the amount of talc that enters the developing container in the case where the paper A2 is passed through is half the amount of talc that enters the developing container in the case where the paper A1 is passed through. In this case, a paper dust concentration index c(a) of talc is newly defined in place of the paper dust concentration indices c(a1) and c(a2) of the papers A1 and A2.

$$c(a)=c(a1)+A\times c(a2)=p(a1)/t+A\times p(a2)/t$$

To be noted, A represents a value indicating the relative likelihood of generation of talc of the paper A2 with respect to the paper A1, and A is ½ in the example described above.

In the present exemplary embodiment, since the value cng of the paper dust concentration index at which background fogging of an unacceptable level is caused by talc is cng=0.41=cng(a1)=cng(a2), toner replenishment notification may be performed when the paper dust concentration index c(a) described above reaches the threshold value cng1=0.4 smaller than the value cng. In this case, the value tlow of toner remaining amount at which toner replenishment notification is performed can be expressed as follows.

$$tlow=(p(a1)+A\times p(a2))/cng1=(p(a1)+\tfrac{1}{2}x\ p(a2))/0.4$$

When the toner remaining amount t in the developing container detected by the toner remaining amount sensor is equal to or smaller than tlow obtained as described above, the image forming apparatus issues toner replenishment notification to the user. As a result of this, toner replenishment notification can be performed at an appropriate timing by, in consideration of likelihood of generation of talc from the paper A1 and the paper A2, more precisely judging the level of toner remaining amount at which background fogging derived from talc does not occur. That is, even in the case where the same paper dust is generated from a plurality of kinds of recording material, the user can be prompted to replenish toner at a more appropriate timing by, in consideration of rate of contribution to decrease in the toner charge amount, determining the value tlow of toner remaining amount at which toner replenishment notification is performed.

Fourth Exemplary Embodiment

Next, an image forming apparatus according to a fourth exemplary embodiment will be described. The present exemplary embodiment is the same as the second exemplary embodiment in that the value of toner remaining amount at which toner replenishment notification is performed is changed, but is different from the second exemplary embodiment in that the amount of paper dust discharged from the developing container is taken into consideration in calculation of the paper dust concentration index. In the description below, elements having substantially the same configuration and effect as in the image forming apparatus of the first to third exemplary embodiments will be denoted by the same reference signs as in the first to third exemplary embodiments and description thereof will be omitted.

Part of paper dust having entered the developing container 37 from the recording material via the photosensitive drum 1 and the developing roller 31 may be born on the developing roller 31 similarly to toner, transferred from the developing roller 31 onto the photosensitive drum 1 in accordance with development of a toner image, and then transferred onto the recording material. That is, it is known that, when the sheet passing operation is performed in the image forming apparatus, entrance of paper dust from the recording material to the developing container 37 and discharge of paper dust from the developing container 37 to the recording material occur in parallel via the photosensitive drum 1 and the developing roller 31.

To be noted, the amount of paper dust, for example, talc, that has been discharged from the developing container 37 and transferred onto the recording material can be confirmed by the following method. An image having an image coverage of 100%, that is, a solid black image, printed on a polyethylene terephthalate: PET film in a state before a fixing process is observed by a digital microscope. Then, the weight of toner and the weight of paper dust are obtained from the number of toner particles and paper dust particles in a certain area, and thus the paper dust concentration [wt %] is calculated. As the digital microscope, VHX 5000 manufactured by Keyence Corporation was used. The paper dust concentration in toner sampled from the developing container 37 can be also obtained by performing the same measurement by placing the sampled toner on the PET film.

In the present exemplary embodiment, it was confirmed that, in the cases where the paper dust concentration of toner sampled from the developing container was 2.5 wt % and 3.5 wt %, paper dust was present in the toner transferred onto the recording material respectively at paper dust concentrations of 0.6 wt % and 0.9 wt %. That is, when the image coverage is 100%, paper dust moves out of the developing container to the recording material together with the toner image at a concentration that is about 25% of the paper dust concentration in the developing container. In other words, the weight of paper dust contained in the developed toner image, that is, the amount of paper dust discharged from the developing container 37 in development can be estimated to be a value obtained by multiplying the weight of the developed toner image by 25% of the paper dust concentration C in the developing container 37. As described above, it has been found that the amount of discharge of paper dust from the developing container 37 onto the recording material is larger in the case where the paper dust concentration in the developing container 37 is larger.

In the first to third exemplary embodiments, description has been given assuming that the amount of paper dust discharged from the developing container 37 is negligible. In the present exemplary embodiment, the paper dust concentration in the developing container is estimated more precisely by taking the amount of paper dust discharged from the developing container 37 into consideration. The method of the present exemplary embodiment is suitable for an image forming apparatus having a configuration in which the paper dust concentration in the developing container can be higher than the maximum value of the paper dust concentration exemplified in the first to third exemplary embodiments, for example, 3.8 wt %.

As compared with the image forming apparatus of the first exemplary embodiment, the pressing force between the photosensitive drum 1 and the transfer roller 5 and the contact pressure between the developing roller 31 and the developing blade 39 are changed in the image forming apparatus of the present exemplary embodiment. The other elements are the same as those described in the first exemplary embodiment, and therefore description thereof will be omitted.

In the present exemplary embodiment, the pressing force between the photosensitive drum 1 and the transfer roller 5 is set to 19.6 N=2000 gf, which is larger than the value 9.8 N of the first exemplary embodiment. As a result of increasing this pressing force, the width of a nip region where the photosensitive drum 1 and the transfer roller 5 are in contact with each other is about 1.6 mm. Since the pressing force is larger than in the first exemplary embodiment, image defects caused by positional deviation between the recording material and the photosensitive drum 1 in the transfer portion can be reduced.

Here, in the case where the pressing force between the photosensitive drum 1 and the transfer roller 5 in the transfer portion is increased, the recording material is pressed strongly against the photosensitive drum 1 in the transfer portion, and therefore paper dust such as filler, additives, and fibers contained in the recording material is more likely to attach to the surface of the photosensitive drum 1. Therefore, as compared with the image forming apparatus of the first exemplary embodiment in which the pressing force is smaller than in the present exemplary embodiment, the amount of paper dust collected into the developing container 37 at the same number of passed-through sheets is large in the present exemplary embodiment. Therefore, in the case where the paper dust generated from the recording material is likely to cause decrease in the toner charge amount, decrease in the toner charge amount which can lead to background fogging can occur even in a state in which the passed-thorough sheet number p is smaller and the toner remaining amount t is larger than in the first exemplary embodiment.

Therefore, in the present exemplary embodiment, the contact pressure between the developing roller 31 and the developing blade 39 is set to 45 gf/cm, which is higher than the value 30 gf/cm of the first exemplary embodiment, in accordance with the change in the pressing force between the photosensitive drum 1 and the transfer roller 5. By increasing the contact pressure between the developing roller 31 and the developing blade 39, the effect of the developing blade 39 frictionally charging the toner can be enhanced, and thus the toner charge amount can be increased.

The toner charge amount, the paper dust concentration C in the developing container, that is, the talc concentration, and whether or not background fogging has occurred were checked while reducing the toner remaining amount by performing the sheet passing operation in the image forming apparatus of the present exemplary embodiment while appropriately adjusting the image coverage. The details of the method of experiment are the same as in the experiment described with reference to Table 1 in the first exemplary embodiment. To be noted, as the recording material, talc paper JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used. The results of the experiment are shown in Table 2.

TABLE 2

| Number of passed-through sheets | Toner charge amount [μC/g] | Paper dust (talc) concentration C [wt %] | Occurrence of background fogging Yes: Bad Slightly: Fair No: Good | Toner remaining amount [g] |
|---|---|---|---|---|
| 0K sheets (initial state) | −50 | 0 | Good | 143 = tfull |

TABLE 2-continued

| Number of passed-through sheets | Toner charge amount [μC/g] | Paper dust (talc) concentration C [wt %] | Occurrence of background fogging Yes: Bad Slightly: Fair No: Good | Toner remaining amount [g] |
|---|---|---|---|---|
| 4K sheets | −33 | 0.8 | Good | 70.1 |
| 5K sheets | −29 | 1.3 | Good | 51.9 |
| 6K sheets | −24 | 2.3 | Fair | 33.6 |
| 7K sheets = png | −20 | 5.5 = Cng | Bad | 15.3 = tng |

Whereas the initial toner charge amount was −40 μC/g in Table 1 of the first exemplary embodiment, the initial toner charge amount increased to −50 μC/g in Table 2 of the present exemplary embodiment as a result of increasing the contact pressure between the developing blade 39 and the developing roller 31. It can be seen that, as the number of passed-through sheets increased, the paper dust concentration C in the developing container increased, and the toner charge amount decreased. In addition, in the present exemplary embodiment, it can be seen that the amount of paper dust entering the developing container increased as a result of increasing the pressing force between the photosensitive drum 1 and the transfer roller 5. Whereas the paper dust concentration C in the developing container at the passed-through sheet number of 7K sheets was 3.8 wt % in Table 1 of the first exemplary embodiment, the paper dust concentration C had increased to 5.5 wt % at the passed-through sheet number of 7K sheets in the Table 2 of the present exemplary embodiment.

Also in the present exemplary embodiment, background fogging of an unacceptable level that is recognized as an image defect occurred in the case where the toner charge amount was equal to or smaller than −20 μC/g similarly to the first exemplary embodiment. The number of passed-through sheets at this time was 7.1K sheets. In addition, the toner charge amount became −24 μC/g when the number of passed-through sheets was 6K sheets, and slight background fogging occurred when the toner charge amount was smaller than −25 μC/g similarly to the first exemplary embodiment. As described above, the passed-through sheet number png, toner remaining amount tng, and paper dust concentration Cng at the time when background fogging of an unacceptable level occurred in the image forming apparatus of the present exemplary embodiment were respectively png=7K sheets, tng=15.3 g, and Cng=5.5 wt %.

Calculation Method for Paper Dust Concentration Index

A calculation method for the paper dust concentration index in the present exemplary embodiment will be described below. Whereas the paper dust concentration index in the first and second exemplary embodiments is defined by the ratio of the passed-through sheet number p to the toner remaining amount t, discharge of paper dust from the developing container 37 onto the recording material is taken into consideration in the present exemplary embodiment.

As described above, the amount of paper dust in the developing container 37 of the present exemplary embodiment increases as a result of paper dust entering the developing container 37 from the recording material in the sheet passing operation and decreases as a result of paper dust being discharged from the developing container 37 onto the recording material in the sheet passing operation. The amount of discharge of paper dust from the developing container 37 onto the recording material depends on the paper dust concentration in the developing container 37 in a state immediately before the sheet passing operation is performed. Therefore, it is appropriate to express the amount of paper dust in the developing container 37 by a recurrence formula that increases/decreases in accordance with the sheet passing operation of the recording material.

In the case where the amount of paper dust after passing the n-th sheet of the recording material through is expressed as $H_n$ [g], $H_n$ can be expressed as follows. To be noted, the paper dust concentration after passing the n-th sheet of the recording material through is expressed as $C_n$ [wt %], and the amount of paper dust that enters the developing container 37 per one passed-through sheet is expressed as h [g]. In addition, the image coverage of an image printed on the n-th sheet of the recording material is expressed as R(n), and the amount of toner consumption per one passed-through sheet in the case of performing printing at an image coverage of 100% is expressed as E [g].

$$H_n=H_{n-1}+h-\{C_{n-1}\times E\times R(n)\times 0.25\} \tag{9}$$

Here, the second term and the third term of the formula (9) respectively represent the amount of paper dust entering the developing container 37 per one passed-through sheet and the amount of paper dust discharged from the developing container 37 per one passed-through sheet. The paper dust concentration $C_n$ in the developing container after passing the n-th sheet of recording material through is expressed as follows by using the amount $H_n$ [g] of paper dust after passing the n-th sheet of recording material through and the toner remaining amount t(n) after passing the n-th sheet of recording material through.

$$C_n=H_n/t(n)=H_{n-1}/t(n)+h/t(n)-\{C_{n-1}\times E\times R(n)\times 0.25\}/t(n)=h/t(n)+[1-\{E\times R(n)\times 0.25\}/t(n)]\times C_{n-1} \tag{10}$$

The formula for calculating the paper dust concentration $C_n$ in the case of passing the recording material through one sheet at a time since the time when the number of passed-through sheets is 0 is written down as follows.

$$C_0 = 0,$$

$$C_1 = h/t(1) + [1 - \{E \times R(1) \times 0.25\}/t(1)] \times C_0 = h/t(1),$$

$$C_2 = h/t(2) + [1 - \{E \times R(2) \times 0.25\}/t(2)] \times C_1,$$

$$C_3 = h/t(3) + [1 - \{E \times R(3) \times 0.25\}/t(3)] \times C_2,$$

$$\cdots$$

$$C_n = h/t(n) + [1 - \{E \times R(n) \times 0.25\}/t(n)] \times C_{n-1}$$

Although the recurrence formulae (9) and (10) described above are updated each time one sheet of recording material is passed through, the frequency of update of the recurrence formulae may be reduced. For example, the recurrence formulae may be updated each time a predetermined number of sheets, for example, "1000 sheets", of recording material set in advance are passed through.

To be noted, the paper dust concentration $C_0$ in the developing container at the time when the number of passed-through sheets is 0 is, since the amount of paper dust in the developing container is 0 g, $C_0$=Ho/t=0 wt %. In addition, the amount E of toner consumed per one passed-through sheet in the case of performing printing at an image coverage of 100% is constant. In addition, the image coverage R(n) is a value that arbitrarily changes for each passed-through sheet and satisfies 0<R(n)<1. R(n)=0 corresponds to a solid white image, and R(n)=1 corresponds to a solid black image.

In addition, the toner remaining amount t(n) is a value that can be obtained by using a detection portion such as the toner remaining amount sensor 54 described in the first exemplary embodiment. In addition, the amount h of paper dust that enters the developing container 37 per one passed-through sheet will be described as a constant value in the present exemplary embodiment. However, in the case of assuming that a plurality of kinds of recording material are passed through as described in the third exemplary embodiment, the paper dust amount h may be set to a different value for each kind of recording material that is passed through.

In the present exemplary embodiment, the paper dust concentration $C_n$ in the developing container expressed by the formula (10) is used as the paper dust concentration index. That is, the paper dust concentration index $C_n$ defined by the formula (10) is another example of an index correlated with the paper dust concentration in the developing container. The image forming apparatus of the present exemplary embodiment monitors the value of the paper dust concentration index $C_n$ that increases and decreases in accordance with the sheet passing operation, and notifies replenishment information prompting the user to perform toner replenishment such that $C_n$ always does not exceed the preset upper limit value. Specifically, as shown in Table 2, in the case where the upper limit value Cng of the paper dust concentration index below which background fogging of an unacceptable level does not occur is 5.5 wt %, a threshold value Cng1 smaller than the upper limit value is set, and toner replenishment notification is performed when the paper dust concentration index $C_n$ has reached the threshold value Cng1. In the present exemplary embodiment, the threshold value Cng1 is set to 5.2 wt %.

The control method for the image forming apparatus in the present exemplary embodiment is basically the same as the control method of the second exemplary embodiment described with reference to FIG. 9, and therefore description thereof will be omitted. However, in the present exemplary embodiment, "paper dust concentration index c" in steps s12, s13, s16, and s17 in FIG. 9 are replaced by "paper dust concentration index $C_n$" defined by the formula (10). In addition, the threshold value "cng1" of steps s13 and s17 are replaced by the threshold value "Cng1" of the paper dust concentration index $C_n$ in the present exemplary embodiment. To be noted, the paper dust concentration index of the present exemplary embodiment is expressed by the recurrence formula described above. Therefore, to execute step s12 or s16, the value of the previous index $C_{n-1}$ is stored in the storage device 52 illustrated in FIG. 2, and the value of the next index $C_n$ is calculated by using the formula (10) with reference to this value.

Figure 15:
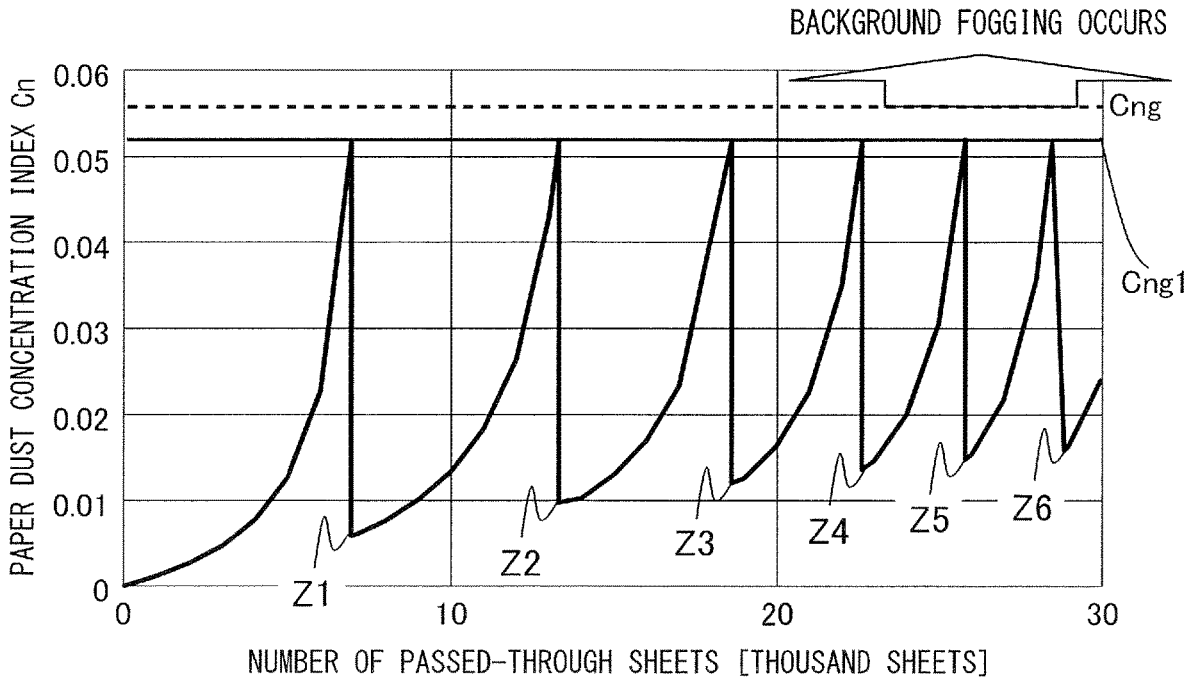
FIG. 15 is a graph showing an example of transition of a paper dust concentration index according to a fourth exemplary embodiment.
Figure 16:
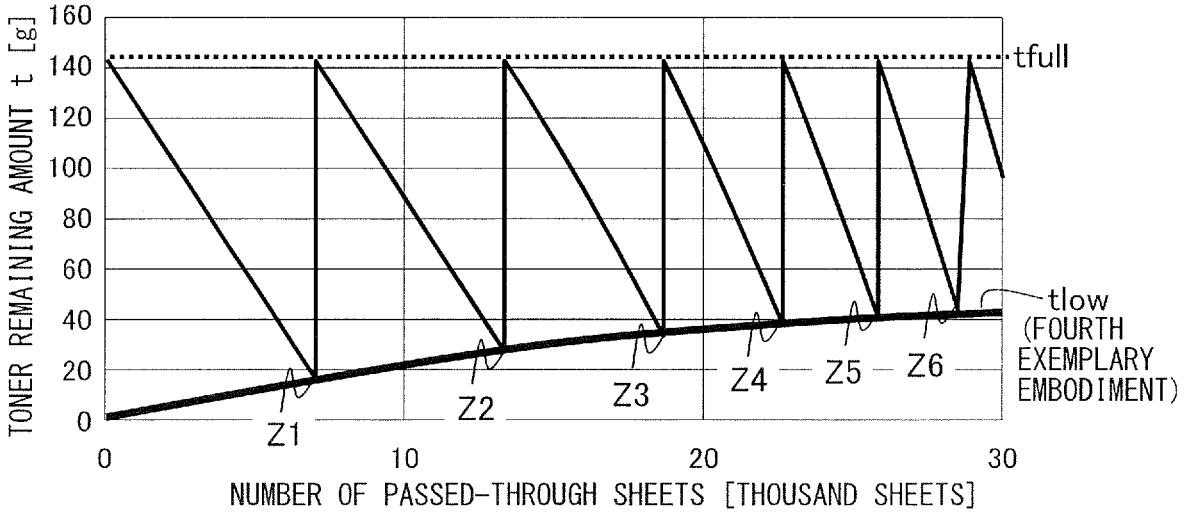
FIG. 16 is a graph showing an example of transition of toner remaining amount according to the fourth exemplary embodiment.

An example of transition of the paper dust concentration index c and the toner remaining amount t in the present exemplary embodiment will be described with reference to specific examples. FIGS. 15 and 16 respectively illustrate the transition of the paper dust concentration index $C_n$ and the toner remaining amount t in the case where the sheet passing test was performed up to 30K sheets, which was the lifetime sheet number of the image forming apparatus. Toner replenishment notification was performed when the paper dust concentration index $C_n$ became equal to or larger than the threshold value Cng1=5.2 wt %, and toner was replenished to the maximum amount tfull=143 g each time. The image coverage was set to be constant at 4%. In addition, the following experiment was conducted in a high-temperature high-humidity environment (32.5° C./80%). As the talc paper, JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used.

In addition, according to an experiment conducted in advance, in the case where printing was performed at an image coverage of 100%, the amount E of toner consumed per one passed-through sheet was 0.455 g, and the amount h of paper dust entering the developing container 37 per one passed-through sheet was 0.000145 g. The amount h [g] of paper dust entering the developing container 37 per one passed-through sheet was empirically obtained by using the relationship of the formula (10), and measured values of the paper dust concentration $C_n$ and the toner remaining amount t. Specifically, a recurrence formula for each 1000 passed-through sheets was generated in the formula (10), and by solving the recurrence formula of the paper dust concentration $C_{4K}$ of the time when the number of passed-through sheets was 4K sheets, $C_{4K}$ was expressed as a polynomial of the paper dust amount h. In addition, the paper dust concentration $C_{4K}$ and the toner remaining amount t(4K) in the case where the image coverage was set to be constant at 4% and 4K sheets were passed through was measured, and as a result, $C_{4K}$=0.79 wt % and t(4K)=71.1 g were obtained. By solving the formula of the paper dust amount h by using these values as constraints, the value of the paper dust amount h described above was obtained. To be noted, the paper dust amount h may be obtained by measuring the paper dust concentration C a plurality of times and performing regression analysis such that the difference between the theoretical value of the paper dust concentration C determined from the paper dust amount h and the measured value of the actual paper dust concentration C is minimized.

In FIGS. 15 and 16, the first toner replenishment notification was performed when the passed-through sheet number p was 6.95K sheets as indicated by Z1 in FIGS. 15 and 16. At this time, the toner remaining amount was 16.2 g, and the paper dust concentration index $C_n$ was 5.2 wt %≈cng1. In addition, the second toner replenishment notification was performed when the passed-through sheet number p was 13.29K sheets as indicated by Z2 in FIGS. 15 and 16. At this time, the toner remaining amount was 27.1 g, and the paper dust concentration index $C_n$ was 5.2 wt %=cng1. At the time of the second toner replenishment notification indicated by Z2 in FIGS. 15 and 16, the toner remaining amount t, that is, tlow was 27.1 g.

That is, the value tlow of toner remaining amount at which the second toner replenishment notification was performed, which served as a second amount, was larger than the value tlow of toner remaining amount at which the first toner replenishment notification had been performed, which served as a first amount. This is because the amount of paper dust in the developing container increased as a result of increase in the passed-through sheet number p, and thus the amount of toner required for maintaining the paper dust concentration in the developing container equal to or smaller than a certain value increased.

The third and subsequent toner replenishment notifications indicated by Z3, Z4, Z5, and Z6 in FIGS. 15 and 16 were also performed when the paper dust concentration index $C_n$ was 5.2 wt %=cng1. Then, the passed-through sheet number p reached 30K sheets, which was the lifetime sheet number of the image forming apparatus, before the seventh toner replenishment notification was performed. The values tlow of toner remaining amount at the time when the third and subsequent toner replenishment notifications indicated by Z3, Z4, Z5, and Z6 were performed were respectively 33.2 g, 37.6 g, 40.6 g, and 43.9 g. That is, in the present exemplary embodiment, the threshold value of toner remaining amount at which toner replenishment notification is performed increases as the passed-through sheet number p increases, and draws a curve that asymptotically approaches a certain value while the increase speed thereof gradually decreases as illustrated in FIG. 16.

This is because, in the present exemplary embodiment, a configuration that allows a state in which the paper dust concentration in the developing container is higher than in the first exemplary embodiment is employed, thus the paper dust concentration in the developing container is higher in a state in which the passed-through sheet number p is larger, and the amount of paper dust discharged from the developing container is larger. If the second term and the third term in the formula (9) are equal to each other, the amount of paper dust in the developing container does not change and remains constant even in the case where the recording material is passed through. The amount of paper dust in the developing container being constant with respect to the passed-through sheet number p indicates that the amount of toner required for keeping the paper dust concentration equal to or smaller than a certain value also settles in a constant value with respect to the passed-through sheet number p. Therefore, for example, as can be seen by comparing the section from 20K sheets to 30K sheets in terms of the number of passed-through sheets illustrated in FIG. 16 with that of the second exemplary embodiment illustrated in FIG. 11, in the present exemplary embodiment, the threshold value of toner remaining amount at which toner replenishment notification is performed settles in a constant value as the passed-through sheet number p increases.

As described above, the value tlow of toner remaining amount at which toner replenishment notification is performed can be prevented from becoming excessively large, by also taking the amount of paper dust discharged from the developing container into consideration. Therefore, as compared with a configuration in which whether or not to perform toner replenishment notification is determined without taking the amount of paper dust discharged from the developing container into consideration, the timing of toner replenishment notification can be delayed without losing the advantage of suppressing occurrence of background fogging of an unacceptable level. That is, by estimating the actual paper dust concentration in the developing container with a higher precision by using the paper dust concentration index $C_n$ of the present exemplary embodiment, the number of times of toner replenishment performed by the user can be optimized while more reliably suppressing occurrence of background fogging of an unacceptable level.

Modification Example

To be noted, although a case where the amount h of paper dust entering the developing container 37 per one passed-through sheet is constant has been described in the present exemplary embodiment, when assuming a case where a plurality of kinds of recording material are passed through as described in the third exemplary embodiment, this value may be also set as a variable for each passed-through sheet. For example, if the amount h of paper dust entering the developing container 37 per one passed-through n-th sheet is set to 0 in the case where calcium carbonate paper, which is not likely to cause decrease in the toner charge amount, is passed through as the n-th sheet, the paper dust concentration $C_n$ after passing the n-th sheet of recording material through is expressed as follows.

$$C_n = h/t(n) + [1 - \{E \times R(n) \times 0.25\}/t(n)] \times C_{n-1} \quad (10')$$
$$= [1 - \{E \times R(n) \times 0.25\}/t(n)] \times C_{n-1}$$

That is, in this formula, the amount of paper dust discharged from the developing container 37 [$\{E \times R(n) \times 0.25\}/t(n) \times C_{n-1}$] is subtracted from the paper dust concentration index $C_{n-1}$ of the time before passing the calcium carbonate paper through. Therefore, in calculation, the paper dust concentration index decreases as the number of passed-through sheets of calcium carbonate paper increases. The same applies to the actual paper dust concentration in the developing container 37, and the actual paper dust concentration in the developing container 37 decreases each time by an amount corresponding to the paper dust included in the consumed toner at 25% of the paper dust concentration in the developing container 37. That is, the amount of paper dust in the developing container 37 decreases, and therefore the amount of toner required for keeping the paper dust concentration in the developing container 37 equal to or lower than a certain value decreases. That is, in the case where paper that does not cause decrease in the toner charge amount is passed through in the middle of a process, the value tlow of toner remaining amount at which toner replenishment is required gradually decreases.

In addition, for example, in the case where a mechanism for collecting paper dust having entered the developing container in the developing container is provided, a formula in which the paper dust concentration is reduced in accordance with the collection efficiency may be used. A case where a collection efficiency U gradually decreases until reaching the lifetime sheet number plife of the image forming apparatus, that is, a case where the collection efficiency U decreases in accordance with the passed-through sheet number p is considered. In this case, by referring to the decrease rate of the collection efficiency at the time when the number of passed-through sheets reaches the lifetime sheet number plife of the image forming apparatus as W, the paper dust concentration index $C_n$ can be expressed as follows.

$$C_n = p/t - U \times (1 - W \times p/\text{plife}) \times p/t \quad (11)$$

The first term indicates that the paper dust concentration C in the developing container is basically expressed by a function p/t of the passed-through sheet number p and the toner remaining amount t similarly to the exemplary embodiments described above. The second term represents the concentration of paper dust collected by the collection mechanism provided in the developing container. The value tlow of toner remaining amount at which toner replenishment notification should be performed in this case is obtained by, in the formula (11), substituting the paper dust concentration index $C_n$ by the threshold value cng1 and the toner remaining amount t by the value tlow of toner remaining amount at which toner replenishment notification is performed.

$$cng1 = \{1 - U \times (1 - W \times p/\text{plife})\} \times p/\text{tlow}$$

That is, tlow is expressed as follows.

$$\text{tlow} = \{1 - U \times (1 - W \times p/\text{plife})\} \times p/cng1$$

As described above, the paper dust concentration index $C_n$ may be appropriately changed such that the paper dust concentration index $C_n$ has a positive correlation with the actual paper dust concentration C in the developing container, particularly such that the positive correlation is a proportional relationship as precise as possible. In the case where the image forming apparatus is capable of more accurately estimate the actual paper dust concentration in the developing container, the toner remaining amount tlow at which toner replenishment is needed can be estimated with a higher accuracy. Further, the number of times of toner replenishment performed by the user can be optimized while more reliably suppressing occurrence of background fogging of an unacceptable level.

Fifth Exemplary Embodiment

In the first to fourth exemplary embodiments described above, the image forming apparatus performs, on the basis of the value of the paper dust concentration index, toner replenishment notification when a possibility that background fogging of an unacceptable level occurs in the case where the sheet passing operation is continued without performing toner replenishment arises. However, it is not always the case that a container for performing toner replenishment such as the toner bottle 12 is always at hand for the user, and a case where toner replenishment cannot be performed right away when the toner replenishment notification is performed can be also considered. Although adding a function of cancelling the toner replenishment notification and allowing the sheet passing operation can be also considered, since the toner charge amount is small in this state, there is a possibility that background fogging of an unacceptable level occurs.

To address this, for example, issuing a preliminary notification to the user when the difference between the current toner remaining amount t and the value tlow of toner remaining amount at which toner replenishment is needed and which is obtained by the method described in the first to fourth exemplary embodiments above becomes smaller than a predetermined threshold value. The preliminary notification is not a notification requesting toner replenishment for now, and for example, is a notification that conveys information prompting preparing the toner bottle 12 or the like for toner replenishment. The notification may be performed by a screen displayed on a display of a PC that transmits the print job, a screen displayed on the display of an operation portion provided in the image forming apparatus, an LED lamp of the operation portion, or the like.

In the preliminary notification, it is preferable to inform the user of a time when it is expected that the toner bottle 12 is needed. In this case, informing the number of sheets estimated to be possible to pass through before the next toner replenishment, by using the result of estimation of the amount of toner consumption per one passed-through sheet obtained from the difference between the toner remaining amount t and the threshold value tlow, the printing history thus far, and the like, can be considered.

Sixth Exemplary Embodiment

Next, an image forming apparatus according to a sixth exemplary embodiment will be described. As a method for addressing the time difference between the toner replenishment notification issued from the image forming apparatus and actual toner replenishment performed by the user, adjusting the operation conditions of the image forming apparatus to suppress occurrence of background fogging can be considered. That is, even in the case where the paper dust concentration in the developing container increases, occurrence of background fogging due to decrease in the toner charge amount can be suppressed if the decrease in the toner charge amount can be suppressed.

In the present exemplary embodiment, as described above, charges of the normal charging polarity are imparted to the toner also by rubbing the toner by the developing blade 39. In this case, the toner can be further charged by a current flowing between the developing blade 39 and the developing roller 31 by applying a bias voltage to the developing blade 39 such that the developing blade 39 is charged to the normal charging polarity with respect to the developing roller 31. Since the normal charging polarity of the toner of the present exemplary embodiment is a negative polarity, by setting the potential of the developing blade 39 higher on the negative side with respect to the potential of the developing roller 31, the toner charge amount can be increased.

In the exemplary embodiments described above, the voltage applied to the developing roller 31 and the developing blade 39 from the high-voltage board 57 illustrated in FIG. 2 is of the same potential. In contrast, in the present exemplary embodiment, the voltage applied to the developing blade 39 is increased in accordance with the paper dust concentration index, and thus the potential difference between the developing blade 39 and the developing roller 31 is increased. This is performed for maintaining the charge amount of toner born on the developing roller 31 even in a state in which the paper dust concentration in the developing container is high.

To be noted, in the case where the potential difference between the developing blade 39 and the developing roller 31 is too large in a state in which the paper dust concentration is low, the toner charge amount becomes too large. Therefore, in the state in which the paper dust concentration is low, the potential difference is set to be small, for example, to 0 V, and the potential difference is increased in accordance with increase in the paper dust concentration. In the case where the toner charge amount is too large, since the amount of charge per unit volume that can be born on the developing roller 31 is constant, the amount of toner born on the developing roller 31 is small, and as a result, the density of toner image formed on the photosensitive drum 1 becomes low.

In addition, in the case where the voltage applied to the developing blade 39 is too high, the potential difference between the developing blade 39 and the developing roller 31 is so large that electrical discharge occurs, and it may become difficult to uniformly charge the toner. In the case where the toner cannot be uniformly charged and a portion where the toner charge amount is reduced is partially generated on the surface of the developing roller 31, background fogging occurs in a part of the image corresponding to the portion. Therefore, care should be taken to not make the potential difference between the developing blade 39 and the developing roller 31 too large.

To be noted, in an experiment conducted in advance in the present exemplary embodiment, in a certain condition, the toner charge amount of toner born on the developing roller 31 was −23 μC/g when a difference $\Delta V = Vdb - Vdc$ between a potential Vdb of the developing blade 39 and a potential Vdc of the developing roller 31 was 0 V. At this time, slight background fogging occurred on the recording material. It is known that, in the same condition as this, by increasing the potential difference ΔV to −200 V by increasing the voltage Vdb applied to the developing blade 39, the toner charge amount is adjusted to −26 μC/g, and thus an image free from background fogging can be obtained.

In addition, when the potential difference ΔV was set to 0 V in a different condition, the toner charge amount was −20 μC/g, and background fogging of an unacceptable level recognized as an image defect occurred on the recording material. It is known that, at this time, by further increasing the potential difference ΔV to −500 V by increasing the voltage Vdb applied to the developing blade 39 in the same condition, the toner charge amount can be adjusted to −22 μC/g, and the degree of background fogging can be suppressed to be low. To be noted, at this time, even in the case where the potential difference ΔV is further increased to −600 V, the toner charge amount does not increase to be equal to or larger than −25 μC/g, and an image free from background fogging cannot be obtained. This is because, as described above, electrical discharge occurs as a result of the excessively large potential difference ΔV, and decrease in the toner charge amount locally occurs. Therefore, in the present exemplary embodiment, the setting range of the potential difference ΔV is −100 V to −500 V.

Table 3 below shows results of an experiment in which sheets of recording material were passed through while increasing the potential Vdb of the developing blade 39. The configuration of the image forming apparatus is the same as in the configuration shown in the first exemplary embodiment except that the potential Vdb of the developing blade 39 can be changed. In the experiment, the toner charge amount, the paper dust concentration C in the developing container, that is, the talc concentration, and whether or not background fogging has occurred were checked while reducing the toner remaining amount by performing the sheet passing operation while appropriately adjusting the image coverage. The details of the method of experiment are the same as in the experiment described with reference to Table 1 in the first exemplary embodiment. To be noted, as the recording material, talc paper JK LEDGER manufactured by JK PAPER (size: 21.59 cm×35.56 cm, grammage: 90 g/m$^2$) left in the high-temperature high-humidity environment (32.5° C./80%) serving as the experimental environment for 2 days was used. In addition, the paper dust concentration index c is expressed by c=p [K sheets]/t by using the passed-through sheet number p and the toner remaining amount t in the developing container similarly to the case described in the first and second exemplary embodiments.

TABLE 3

| Number of passed-through sheets | Toner charge amount [μC/g] | Paper dust (talc) concentration C [wt %] | Toner remaining amount [g] | Paper dust concentration index Cn | Set potential difference ΔV | Occurrence of background fogging Yes: Bad Slightly: Fair No: Good |
|---|---|---|---|---|---|---|
| 0K sheets (initial state) | −40 | 0 | 143 = tfull | 0 | 0 V | Good |
| 4K sheets | −28 | 0.5 | 74.3 | 0.05 | 0 V | Good |
| 5K sheets | −26 | 0.8 | 55.4 | 0.09 | −200 V | Good |
| 6K sheets | −25 | 1.5 | 36.4 | 0.16 | −400 V | Good |
| 6.95K sheets | −22 | 3.65 | 17.5 = tlow | 0.40 = Cng' | −400 V | Fair |
| 7K sheets | −22 | 3.8 | 17 | 0.41 | −500 V | Fair |
| 7.2K sheets | −20 | 5.5 | 13 | 0.55 | −500 V | Bad |

In the present exemplary embodiment, similarly to the first exemplary embodiment, the toner charge amount was −40 μC/g and background fogging did not occur in the initial state in which the paper dust concentration C in the developing container was 0 wt %. It can be seen that, as the number of passed-through sheets increased, the paper dust concentration C in the developing container increased, and the toner charge amount decreased. At the time when the number of passed-through sheets was 5K sheets, the paper dust concentration C had increased to 0.8 wt %. In the first exemplary embodiment corresponding to Table 1, the toner charge amount was smaller than −25 μC/g when the number of passed-through sheets reached 5K sheets, and slight background fogging was recognized on the recording material. In contrast, in the present exemplary embodiment, the potential difference ΔV between the developing blade 39 and the developing roller 31 was changed to −200 V before the number of passed-through sheets reached 5K sheets. As a result, the value of the toner charge amount at the time when the number of passed-through sheets was 5K sheets in the present exemplary embodiment was −26 μC/g, which was larger than −23 μC/g of the first exemplary embodiment, and no background fogging was recognized on the recording material.

Then, at the time when the number of passed-through sheets was 6K sheets, the potential difference ΔV had been further increased to −400 V As a result, the value of the toner charge amount at the time when the number of passed-through sheets in the present exemplary embodiment was 6K sheets was −25 μC/g, which was larger than −21 μC/g of the first exemplary embodiment, and no background fogging was recognized on the recording material.

Further, when the number of passed-through sheets reached 7K sheets, the paper dust concentration C in the developing container had increased to 3.8 wt %. At this time, in the first exemplary embodiment corresponding to Table 1, the toner charge amount was −20 μC/g, and background fogging of an unacceptable level occurred. In contrast, in the present exemplary embodiment corresponding to Table 3, as a result of increasing the potential difference ΔV to −500 V, the toner charge amount was adjusted to −22 μC/g, and slight background fogging occurred on the recording material.

Then, when the number of passed-through sheets reached 7.2K sheets, the paper dust concentration C had increased to 5.5 wt %. At this time, the toner charge amount was −20 μC/g even in the case where the potential difference ΔV was set to −500 V, and background fogging of an unacceptable level occurred.

As described above, it has been confirmed that occurrence of background fogging can be delayed by changing the potential difference ΔV between the developing blade 39 and the developing roller 31 in accordance with the increase in the paper dust concentration C in the developing container. Therefore, it can be seen that setting may be performed such that the potential difference ΔV is increased by increasing the potential Vdb of the developing blade 39 in accordance with the increase in the paper dust concentration in the developing container. Specifically, the potential Vdb of the developing blade 39 may be changed by using a paper dust concentration index correlated with the paper dust concentration C in the developing container as described in the first to fifth exemplary embodiments.

Control Method for Toner Replenishment Notification

Figure 17:
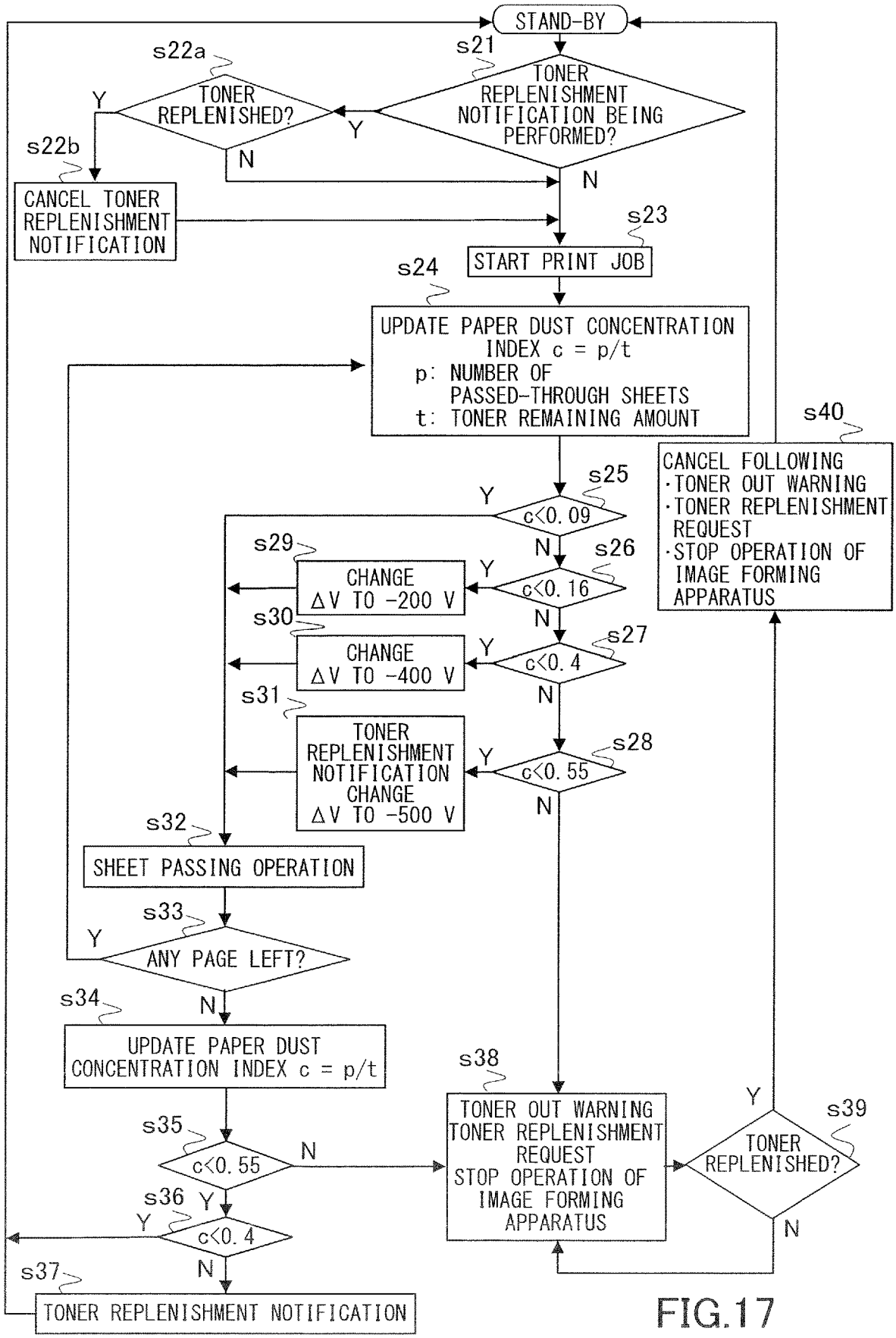
FIG. 17 is a flowchart illustrating a method of processing a print job according to a sixth exemplary embodiment.

FIG. 17 is a flowchart illustrating a control method for the image forming apparatus of the present exemplary embodiment. Each step of this process is executed by the CPU 51 of the controller 50 illustrated in FIG. 2 reading and executing a control program stored in the storage device 52. Processing of each step of the flowchart will be described below with reference to FIG. 2.

Steps s21 and s22

In the present exemplary embodiment, unlike the first to fifth exemplary embodiments in which the operation of the image forming apparatus is stopped when toner replenishment notification is performed, a print job can be received even in a state in which toner replenishment notification is performed. Therefore, in the stand-by state, whether or not toner replenishment notification is currently being performed is determined in step s21. In a state in which toner replenishment notification is being performed, whether or not toner has been replenished in the stand-by state is determined in step s22*a*. When toner is replenished, the toner replenishment notification is cancelled in step s22*b*. To be noted, whether or not toner replenishment has been performed may be determined by detecting opening/closing of the opening portion 34 provided in the developing container 37, or by detecting increase in the toner remaining amount t by the toner remaining amount sensor.

Steps s23 and s24

When a print job is input to the image forming apparatus in the stand-by state, the CPU 51 starts executing the print job in step s23. At this time, in step s24, the paper dust concentration index c=p [K sheets]/t is calculated again by using the toner remaining amount t in the developing container detected by using the toner remaining amount sensor 54 and the passed-through sheet number p of the image forming apparatus, and thus the value of the paper dust concentration index c is updated. The new value of the toner remaining amount t is stored in a storage area prepared in the storage device 52.

Steps s25 to s31

In the present exemplary embodiment, the potential difference between the developing blade 39 and the developing roller 31 is determined by using the experimental results shown in Table 3 in accordance with the value of the paper dust concentration index c obtained in step s24. In the case where the paper dust concentration index c is equal to or larger than 0 and smaller than 0.09, the potential difference ΔV is not changed and remains at 0 V in step s25. In the case where the paper dust concentration index c is equal to or larger than 0.09 and smaller than 0.16, the potential difference ΔV is set to −200 V in step s26 or s29. In the case where the paper dust concentration index c is equal to or larger than 0.16 and smaller than 0.4, the potential difference ΔV is set to −400 V in step s27 or s30. In the case where the paper dust concentration index c is equal to or larger than 0.4 and smaller than 0.55, the potential difference ΔV is set to −500 V in step s28 or s31. As described above, the potential difference ΔV between the developing blade 39 and the developing roller 31 is configured to also increase stepwise as the paper dust concentration index c increases in accordance with increase in the number of passed-through sheets. To be noted, the potential difference ΔV may be continuously changed in accordance with the paper dust concentration index c.

In the case where the paper dust concentration index c is smaller than 0.55 in steps s25 to s31, it is determined that printing can be performed by setting the potential difference ΔV to an appropriate value. In contrast, in the case where the paper dust concentration index c is equal to or larger than 0.55, it is determined that occurrence of background fogging of an unacceptable level cannot be sufficiently suppressed even if the potential difference ΔV is adjusted, and therefore it is determined that printing cannot be performed. In this case, operation of the image forming apparatus is stopped by processing of step s38 and subsequent steps that will be described later.

Step s31

In step s31, not only the potential difference ΔV is set to ΔV=−500 V, but also toner replenishment notification is performed at the same time. As a result of this, the user receives the toner replenishment notification before the paper dust concentration index c exceeds 0.55 and the operation of the image forming apparatus stops, and is thus given an opportunity to prepare toner for replenishment such as the toner bottle 12. In addition, this toner replenishment notification is not performed until the paper dust concentration index c exceeds cng'=0.4, and therefore the frequency of requesting toner replenishment from the user does not become too high. In the present exemplary embodiment, in consideration of the balance between the room for preparing the toner for replenishment and the frequency of requesting toner replenishment from the user, the threshold value cng' of the paper dust concentration index c for performing toner replenishment notification is set to 0.4.

Steps s32 to s37

In the case where it is determined in steps s25 to s31 that printing can be performed, the CPU 51 performs the sheet passing operation of feeding the recording material and forming an image on the recording material in s32. At this time, the potential difference ΔV set in steps s25 to s31 is generated between the developing blade 39 and the developing roller 31 by the CPU 51 sending a command to the high-voltage board 57 to control the voltage applied to the developing blade 39. As a result of this, occurrence of background fogging of an unacceptable level is reduced even in a state in which the paper dust concentration index c has increased to some degree.

In the case where the print job requests image formation on a plurality of sheets of the recording material and there is a page yet to be subjected to image formation, that is, in the case where the result of step s33 is Y, the process returns to step s24 and the processing described above is repeated. In the case where there is no page yet to be subjected to image formation remaining, that is, in the case where the sheet passing operation has been performed on the last recording material in the job, in other words, in the case where the result of step s33 is N, the paper dust concentration index c is updated in step s34. In the case where the value of the updated paper dust concentration index c is equal to or larger than the threshold value, which is 0.55 in this case, for determining whether or not printing can be performed, that is, in the case where the result of step s35 is N, the process proceeds to step s38 and the operation of the image forming apparatus is stopped. In the case where the value of the updated paper dust concentration index c is smaller than 0.55 and equal to or larger than the threshold value cng'=0.4 for performing toner replenishment notification, that is, in the case where the result of step s36 is N, toner replenishment notification is performed and the image forming apparatus returns to the stand-by state in step s37. In the case where the value of the updated paper dust concentration index c is smaller than cng'=0.4, that is, in the case where the result of s36 is Y, it is determined that toner replenishment notification does not need to be performed, and the image forming apparatus returns to the stand-by state.

Steps s38 to s40

In the case where it is determined in step s28 or s35 that the paper dust concentration index c is equal to or larger than 0.55, the process proceeds to step s38, and the operation of the image forming apparatus is stopped such that no print job can be received. This is because, as shown in Table 3, in the case where the paper dust concentration index exceeds 0.55, the toner charge amount cannot be maintained at a value larger than −20 μC/g even if the potential difference ΔV is set to −500 V, and thus background fogging of an unacceptable level occurs. That is, in the case where a print job is input by the user neglecting the toner replenishment notification after performing toner replenishment notification, although the image forming apparatus continues the sheet passing operation while adjusting the voltage applied to the developing blade 39, eventually the operation of the image forming apparatus is stopped before background fogging of an unacceptable level occurs.

In step s38, "TONER OUT" warning and a toner replenishment request are performed when the operation of the image forming apparatus is stopped. The TONER OUT warning is information warning that there is a possibility that printing cannot be performed normally due to shortage of toner in the developing container. In addition, the toner replenishment request is information prompting the user to perform toner replenishment. The TONER OUT warning and the toner replenishment request can be performed by a screen displayed on the display of an operation portion provided in the image forming apparatus, an LED lamp of the operation portion, or a screen displayed on a display of a PC connected to the image forming apparatus similarly to the toner replenishment notification. To be noted, since the toner replenishment request prompts the user to perform toner replenishment similarly to toner replenishment notification, the contents thereof may be the same.

Then, after toner replenishment is performed, the TONER OUT warning, the toner replenishment request, and the stop state of the operation of the image forming apparatus are all cancelled in step s39. When toner replenishment is performed, the toner remaining amount t detected by the toner remaining amount sensor increases. Therefore, when the next print job is input, the value of the paper dust concentration index c is smaller than the state before toner replenishment, and printing is performed.

As described above, also in the present exemplary embodiment, toner replenishment notification and toner replenishment request serving as examples of notification of replenishment information to the user are performed in accordance with the value of the paper dust concentration index c. Therefore, similarly to the first to fifth exemplary embodiments, the user can be prompted to perform toner replenishment before background fogging of an unacceptable level occurs. In addition, in the present exemplary embodiment, by adjusting the potential difference ΔV between the developing blade 39 and the developing roller 31, printing can be performed while suppressing occurrence of background fogging of an unacceptable level even after the toner replenishment notification is performed. As a result of this, a time for the user to get toner for replenishment can be secured, and thus an image forming apparatus with high usability can be provided.

To be noted, although the potential difference ΔV between the developing blade 39 and the developing roller 31 is adjusted in the present exemplary embodiment, the occurrence of background fogging in a state in which the paper dust concentration is high can be reduced also by changing other image formation conditions. For example, occurrence of background fogging can be reduced by increasing the potential difference between the developing roller 31 and an unexposed portion of the photosensitive drum 1 in accordance with the increase in the paper dust concentration index c. This potential difference is also referred to as a fog removing potential Vback.

Other Embodiments

Although an image forming apparatus of a direct replenishment system has been described as an example of toner replenishment system in the exemplary embodiments described above, this technique can be also applied to other image forming apparatuses. For example, there is an image forming apparatus of a successive replenishment system in which a toner container such as a toner bottle can be attached to the body of the image forming apparatus in addition to the developing container and toner is delivered into the developing container from the toner container little by little. As a method for delivering toner into the developing container from the toner container, for example, an opening portion of the toner container is connected to the opening portion of the developing container, and an agitation blade disposed in the toner container moves the toner toward the opening portion in accordance with rotation of the toner container. Also in such an image forming apparatus, a situation in which the paper dust concentration in the developing container increases is expressed as a paper dust concentration index in consideration of the amount of toner delivered into the developing container from the toner container by the agitation blade little by little. By performing toner replenishment notification before such a paper dust concentration index reaches an upper limit value set in advance, occurrence of background fogging derived from paper dust can be suppressed.

In addition, also in an image forming apparatus employing a successive replenishment system among toner replenishment systems, toner in the developing container starts gradually decreasing when the toner container is empty. In this case, for example, occurrence of background fogging can be suppressed without a serious problem by appropriately changing the image formation conditions in accordance with the paper dust concentration index.

In addition, although the toner remaining amount sensor 54 capable of continuously detecting the toner remaining amount has been described as an example of a detection portion that detects the amount of developer remaining in the developing container in the first to fifth exemplary embodiments described above, other detection mechanisms may be used. For example, the remaining amount of developer may be detected by using a pressure sensor disposed on a wall surface of the developing container 37. To be noted, a sensor that can only determine whether or not the amount of developer remaining in the developing container is equal to or larger than a predetermined amount may be used. In this case, the current toner remaining amount can be estimated by estimating, by using information of pixel count, image coverage, and the like, the amount of toner consumption since the time point when it has been detected by the sensor that the remaining amount of developer has reached the predetermined amount.

As described above, according to the technique of the present disclosure, an image forming apparatus capable of more reliably reduce occurrence of background fogging derived from paper dust can be provided.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-049202, filed on Mar. 15, 2019, which is hereby incorporated by reference herein in its entirety.

What is claimed is:

1. An image forming apparatus configured to form an image on a recording material, the image forming apparatus comprising:

a rotatable image bearing member configured to bear an electrostatic latent image;

a developing container configured to accommodate developer comprising toner and to allow new developer to be replenished by a developer replenishing container;

a developer bearing member configured to develop the electrostatic latent image born on the image bearing member into a toner image by using the developer in the developing container;

a transfer roller configured to transfer the toner image born on the image bearing member onto the recording material; and a controller configured to notify replenishment information for prompting replenishing the developing container with the new developer by the developer replenishing container, the controller being configured to notify the replenishment information in a state in which an index correlated with a ratio of an amount of paper dust mixed in the developer in the developing container to an amount of the developer in the developing container has not exceeded a preset threshold value of the index, wherein the controller is configured to notify the replenishment information in a case where the amount of the developer in the developing container is equal to or smaller than a threshold value of the amount of the developer, and wherein the threshold value of the amount of the developer is a constant value preset such that the index does not exceed the threshold value of the index.

2. The image forming apparatus according to claim 1, wherein the index represents a ratio of accumulated number of sheets of the recording material on which images have been formed to the amount of the developer in the developing container.

3. The image forming apparatus according to claim 1, wherein the index represents a ratio of the amount of the paper dust in the developing container to the amount of the developer in the developing container, and wherein the amount of the paper dust in the developing container is updated each time images are formed on a predetermined number of sheets of the recording material, the amount of the paper dust in the developing container being updated on a basis of an amount of paper dust entering the developing container from the recording material via the image bearing member and the developer bearing member and an amount of paper dust discharged from the developing container onto the recording material through the developer bearing member and the image bearing member.

4. The image forming apparatus according to claim 1, further comprising a detector attached to the developing container, and configured to detect the amount of the developer in the developing container, wherein the controller is configured to notify the replenishment information on a basis of a detection result of the detector.

5. The image forming apparatus according to claim 1, wherein the image forming apparatus is capable of forming images on a plurality of kinds of recording materials, and wherein the threshold value of the amount of the developer is changed in accordance with the kind of the recording material on which an image has been formed.

6. The image forming apparatus according to claim 1, wherein the developer bearing member is configured to collect, into the developing container, toner that is not transferred onto the recording material by the transfer roller after being supplied to the image bearing member from the developer bearing member in a developing region where the image bearing member and the developer bearing member face each other and that is not used for development of the electrostatic latent image when reaching the developing region again by rotation of the image bearing member.

7. The image forming apparatus according to claim 1, wherein an opening portion is provided in the developing container, and the developing container is configured such that the developer can be supplied to the developing container from an outside of the image forming apparatus through the opening portion in a state in which the developing container is attached to a body of the image forming apparatus.

8. The image forming apparatus according to claim 1, further comprising a display apparatus configured to display information as an image, wherein the controller is configured to notify the replenishment information via the display apparatus.

9. The image forming apparatus according to claim 1, wherein the controller is configured to notify the replenishment information via a display apparatus provided in an external apparatus by communicating with the external apparatus.

10. An image forming apparatus configured to form an image on a recording material, the image forming apparatus comprising:

a rotatable image bearing member configured to bear an electrostatic latent image;

a developing container configured to accommodate developer comprising toner;

a developer bearing member configured to develop the electrostatic latent image born on the image bearing member into a toner image by using the developer in the developing container;

a transfer roller configured to transfer the toner image born on the image bearing member onto the recording material; and a controller configured to notify replenishment information for prompting replenishing the developing container with the developer, wherein, in a case where the developing container is replenished with the developer after the controller notifies the replenishment information of a previous time when an amount of the developer in the developing container is smaller than a first amount, the controller notifies the replenishment information of a next time when the amount of the developer in the developing container is smaller than a second amount larger than the first amount.

11. An image forming apparatus configured to form an image on a recording material, the image forming apparatus comprising:

a rotatable image bearing member configured to bear an electrostatic latent image;

a developing container configured to accommodate developer comprising toner and allow new developer to be replenished by a developer replenishing container;

a developer bearing member configured to develop the electrostatic latent image born on the image bearing member into a toner image by using the developer in the developing container;

a transfer roller configured to transfer the toner image born on the image bearing member onto the recording material; and a controller configured to notify replenishment information for prompting replenishing the developing container with the developer by the developer replenishing container, wherein, in a case of forming an image on a recording material of a first kind of material in an initial state in which a predetermined amount of the developer is accommodated in the developing container and paper dust is not mixed in the developer in the developing container, the controller notifies the replenishment information in a case where an accumulated number of sheets of the recording material of the first kind of material on which images have been formed has exceeded a first number of sheets, and wherein, in a case of forming an image on a recording material of a second kind of material different from the recording material of the first kind of material in the initial state, the controller notifies the replenishment information in a case where an accumulated number of sheets of the recording material of the second kind of material on which images have been formed has exceeded a second number of sheets larger than the first number of sheets.

12. The image forming apparatus according to claim 11, wherein the recording material of the first kind of material is paper containing talc as filler, and wherein the recording material of the second kind of material is paper containing calcium carbonate as filler.

13. An image forming apparatus configured to form an image on a recording material, the image forming apparatus comprising:

a rotatable image bearing member configured to bear an electrostatic latent image;

a developing container configured to accommodate developer comprising toner and to allow new developer to be replenished by a developer replenishing container;

a developer bearing member configured to develop the electrostatic latent image born on the image bearing member into a toner image by using the developer in the developing container;

a transfer roller configured to transfer the toner image born on the image bearing member onto the recording material; and a controller configured to notify replenishment information for prompting replenishing the developing container with the new developer by the developer replenishing container, the controller being configured to notify the replenishment information in a state in which an index correlated with a ratio of an amount of paper dust mixed in the developer in the developing container to an amount of the developer in the developing container has not exceeded a preset threshold value of the index, wherein the controller is configured to notify the replenishment information in a case where the amount of the developer in the developing container is equal to or smaller than a threshold value of the amount of the developer, and wherein a larger value is set as the threshold value of the amount of the developer in a case of next notification of the replenishment information than in a case of previous notification of the replenishment information.

14. The image forming apparatus according to claim 13, further comprising a detector attached to the developing container and configured to detect the amount of the developer in the developing container, wherein the controller is configured to notify the replenishment information on a basis of a detection result of the detector.

15. The image forming apparatus according to claim 13, wherein the image forming apparatus is capable of forming images on a plurality of kinds of recording materials, and wherein the threshold value of the amount of the developer is changed in accordance with the kind of the recording material on which an image has been formed.

16. The image forming apparatus according to claim 13, wherein the developer bearing member is configured to collect, into the developing container, toner that is not transferred onto the recording material by the transfer roller after being supplied to the image bearing member from the developer bearing member in a developing region where the image bearing member and the developer bearing member face each other and that is not used for development of the electrostatic latent image when reaching the developing region again by rotation of the image bearing member.

17. The image forming apparatus according to claim 13, wherein an opening portion is provided in the developing container, and the developing container is configured such that the developer can be supplied to the developing container from an outside of the image forming apparatus through the opening portion in a state in which the developing container is attached to a body of the image forming apparatus.

18. The image forming apparatus according to claim 13, further comprising a display apparatus configured to display information as an image, wherein the controller is configured to notify the replenishment information via the display apparatus.

19. The image forming apparatus according to claim 13, wherein the controller is configured to notify the replenishment information via a display apparatus provided in an external apparatus by communicating with the external apparatus.

* * * * *